US008418489B2

(12) United States Patent
Okamoto

(10) Patent No.: US 8,418,489 B2
(45) Date of Patent: Apr. 16, 2013

(54) CONTROL OF SUPERCRITICAL REFRIGERATION SYSTEM

(75) Inventor: Masakazu Okamoto, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 603 days.

(21) Appl. No.: 12/225,577

(22) PCT Filed: Mar. 26, 2007

(86) PCT No.: PCT/JP2007/056221

§ 371 (c)(1),
(2), (4) Date: Sep. 25, 2008

(87) PCT Pub. No.: WO2007/111303

PCT Pub. Date: Oct. 4, 2007

(65) Prior Publication Data

US 2009/0260380 A1 Oct. 22, 2009

(30) Foreign Application Priority Data

Mar. 27, 2006 (JP) ..... 2006-084958

(51) Int. Cl.
*F25B 41/04* (2006.01)

(52) U.S. Cl.
USPC ..... 62/222; 62/204; 62/205

(58) Field of Classification Search ..... 62/204, 62/205, 222
See application file for complete search history.

(56) References Cited

U.S. PATENT DOCUMENTS

| | | | | |
|---|---|---|---|---|
| 5,934,094 | A * | 8/1999 | Itoh et al. | 62/222 |
| 6,044,655 | A * | 4/2000 | Ozaki et al. | 62/205 |
| 2005/0284164 | A1* | 12/2005 | Ohta | 62/228.3 |
| 2006/0288719 | A1* | 12/2006 | Shapiro et al. | 62/228.3 |
| 2007/0251245 | A1* | 11/2007 | Sakitani et al. | 62/6 |

FOREIGN PATENT DOCUMENTS

| | | | |
|---|---|---|---|
| DE | 2006-10136 | A | 1/2006 |
| JP | 10-89780 | A | 4/1998 |
| JP | 11-270918 | A | 10/1999 |
| JP | 2001-133058 | A | 5/2001 |
| JP | 2001-194017 | A | 7/2001 |
| JP | 2002-156146 | A | 5/2002 |

* cited by examiner

*Primary Examiner* — Cheryl J Tyler
*Assistant Examiner* — Jonathan Bradford
(74) *Attorney, Agent, or Firm* — Birch, Stewart, Kolasch & Birch, LLP

(57) ABSTRACT

A refrigeration system includes a refrigerant circuit performing a vapor compression supercritical refrigeration cycle. The system includes a compression mechanism, a heat source heat exchanger, an expander, and a utilization heat exchanger. The expander includes, for two-stage compression, a high pressure side and a low pressure side throttle mechanism, both variable in the amount of throttling. A controller is configured to derive a target value, providing a maximum COP, for the pressure of high pressure refrigerant in the refrigerant circuit based on the temperature of refrigerant at the outlet of either the heat source side heat exchanger or the utilization side heat exchanger, whichever becomes a heat dissipation side heat exchanger functioning as a heat dissipation unit and on the temperature of a medium exchanging heat with refrigerant in the heat dissipation side heat exchanger, at the inlet of the heat dissipation side heat exchanger.

18 Claims, 16 Drawing Sheets

CONTROL OF SUPERCRITICAL REFRIGERATION SYSTEM

TECHNICAL FIELD

The present invention relates to the field of refrigeration systems. More specifically, this invention is concerned with measures for the coefficient of performance in a refrigeration system operating on a supercritical refrigeration cycle.

BACKGROUND ART

There are conventional refrigeration systems of the type that have a refrigerant circuit which employs carbon dioxide as a refrigerant and performs a vapor compression refrigeration cycle using a supercritical cycle (see JP-A-2001-133058).

Such a prior art refrigeration system is provided with a refrigerant circuit including a lower stage compressor, a higher stage compressor, a heat dissipation side heat exchanger, a first pressure reduction unit, a gas-liquid separator, and a second pressure reduction unit which are connected sequentially, wherein gas refrigerant in the gas-liquid separator is directed to between the lower stage compressor and the higher stage compressor.

The aforesaid refrigeration system uses a supercritical cycle. Therefore, in the heat dissipation side heat exchanger, the refrigerant enters a supercritical state and no condensation temperature exists. Therefore, based on the temperature of refrigerant at the outlet of the heat dissipation side heat exchanger or based on the temperature of air around the heat dissipation side heat exchanger, the amount of pressure reduction by at least either one of the first and second pressure reduction units is controlled such that the pressure of high pressure refrigerant in the refrigerant circuit is optimized.

DISCLOSURE OF THE INVENTION

Problems that the Invention Intends to Overcome

However, in the conventional refrigeration system, only either one of the outlet refrigerant temperature of the heat dissipation side heat exchanger and the ambient air temperature of the heat dissipation side heat exchanger is used. This produces problems. That is, it is not necessarily the case that the pressure of high pressure refrigerant becomes an optimum value, and it can hardly be said that the coefficient of performance (COP) is always optimum.

That is, if both the outlet refrigerant temperature of the heat dissipation side heat exchanger and the ambient air temperature of the heat dissipation side heat exchanger change, this accompanies a change in the high pressure refrigerant pressure of the refrigerant circuit. Therefore, the coefficient of performance (COP) of the refrigeration system changes due to the high pressure refrigerant pressure, the outlet refrigerant temperature of the heat dissipation side heat exchanger, and the ambient air temperature of the heat dissipation side heat exchanger.

In the conventional refrigeration system, the amount of pressure reduction is controlled either based on the high pressure refrigerant pressure of the refrigerant circuit and the outlet refrigerant temperature of the heat dissipation side heat exchanger, or based on the high pressure refrigerant pressure of the refrigerant circuit and the ambient air temperature of the heat dissipation side heat exchanger change. As a result, it can hardly be said that the conventional refrigeration system always operates at an optimum coefficient of performance (COP).

In view of the above, the present invention was made. Accordingly, an object of the present invention is to enable a refrigeration system provided with a supercritical refrigeration cycle refrigerant circuit to operate at an optimum coefficient of performance (COP).

Means for Overcoming the Problems

The present invention provides, as a first aspect, a refrigeration system including a refrigerant circuit (20) that has, in order to perform a vapor compression supercritical refrigeration cycle, a compression mechanism (30), a heat source side heat exchanger (21), an expansion mechanism (40), and a utilization side heat exchanger (23), wherein the expansion mechanism (40) includes, for two-stage compression of refrigerant in the refrigerant circuit (20), a high pressure side throttle mechanism (41, 42) variable in the amount of throttling and a low pressure side throttle mechanism (42, 41) variable in the amount of throttling.

In addition, the refrigeration system of the first aspect includes a high pressure control means (61) which performs: derivation of a target value for the pressure of high pressure refrigerant in the refrigerant circuit (20) from i) the temperature of refrigerant at the outlet of either the heat source side heat exchanger (21) or the utilization side heat exchanger (23), whichever becomes a heat dissipation side heat exchanger functioning as a heat dissipation unit and ii) the temperature of medium, which medium exchanges heat with refrigerant in the heat dissipation side heat exchanger, at the inlet of the heat dissipation side heat exchanger; and high pressure control by adjusting the amount of throttling of the expansion mechanism (40) so that the aforesaid high pressure refrigerant pressure is controlled to the target value.

The relationship between the high pressure refrigerant pressure of the refrigerant circuit (20) and the outlet refrigerant temperature of the heat dissipation side heat exchanger is determined by the inlet medium temperature of the heat dissipation side heat exchanger. Therefore, in the first aspect of the present invention, the target value for the high pressure refrigerant pressure of the refrigerant circuit (20) which target value provides an optimum COP is derived from the inlet medium temperature of the heat dissipation side heat exchanger and the outlet refrigerant temperature of the heat dissipation side heat exchanger. And the amount of throttling of the expansion mechanism (40) is adjusted so that the high pressure refrigerant pressure becomes the target value.

The present invention provides, as a second aspect, a refrigeration system including a refrigerant circuit (20) that has, in order to perform a vapor compression supercritical refrigeration cycle, a compression mechanism (30), a heat source side heat exchanger (21), an expansion mechanism (40), and a utilization side heat exchanger (23), wherein the expansion mechanism (40) includes, for two-stage compression of refrigerant in the refrigerant circuit (20), a high pressure side throttle mechanism (42) variable in the amount of throttling and a low pressure side throttle mechanism (41) variable in the amount of throttling.

In addition, the refrigeration system of the second aspect includes an outlet temperature control means (63) which performs in the heating operation mode of the refrigerant circuit (20): derivation of a target value for the temperature of refrigerant at the outlet of the utilization side heat exchanger (23) from i) the temperature of medium, which medium exchanges heat with refrigerant in the utilization side heat exchanger (23), at the inlet of the utilization side heat exchanger (23) and ii) the preset pressure value for the pressure of high pressure refrigerant in the refrigerant circuit (20); and outlet temperature control by adjusting the amount of throttling of the expansion mechanism (40) so that the aforesaid outlet refrigerant temperature is controlled to the target value.

The relationship between the high pressure refrigerant pressure of the refrigerant circuit (20) and the outlet refrigerant temperature of the utilization side heat exchanger (23) is determined by the inlet medium temperature of the utilization side heat exchanger (23). Therefore, in the second aspect of the present invention, the target value for the outlet refrigerant temperature of the utilization side heat exchanger (23) which target value provides an optimum COP is derived from the preset value for the high pressure refrigerant pressure and the inlet medium temperature of the utilization side heat exchanger (23). And the amount of throttling of the expansion mechanism (40) is adjusted so that the outlet refrigerant pressure becomes the target value.

The present invention provides, as a third aspect, a refrigeration system including a refrigerant circuit (20) that has, in order to perform a vapor compression supercritical refrigeration cycle, a compression mechanism (30), a heat source side heat exchanger (21), an expansion mechanism (40), and a plurality of utilization side heat exchangers (23) connected in parallel with each other, wherein the expansion mechanism (40) includes, for two-stage compression of refrigerant in the refrigerant circuit (20), a heat source side throttle mechanism (41) variable in the amount of throttling and associated with the heat source side heat exchanger (21) and a plurality of utilization side throttle mechanisms (42) variable in the amount of throttling and associated respectively with the plurality of utilization side heat exchangers (23).

In addition, the refrigeration system of the third aspect includes a high pressure control means (61) which performs in the cooling operation mode of the refrigerant circuit (20): derivation of a target value for the pressure of high pressure refrigerant in the refrigerant circuit (20) from i) the temperature of refrigerant at the outlet of the heat source side heat exchanger (21) and ii) the temperature of medium, which medium exchanges heat with refrigerant in the heat source side heat exchanger (21), at the inlet of the heat source side heat exchanger (21); and high pressure control by adjusting the amount of throttling of the expansion mechanism (40) so that the aforesaid high pressure refrigerant pressure is controlled to the target value.

Furthermore, the refrigeration system of the third aspect includes an outlet temperature control means (63) which performs in the heating operation mode of the refrigerant circuit (20): derivation of a target value for the temperature of refrigerant at the outlet of the utilization side heat exchanger (23) from i) the temperature of medium, which medium exchanges heat with refrigerant in the utilization side heat exchanger (23), at the inlet of the utilization side heat exchanger (23) and ii) the preset pressure value for the pressure of high pressure refrigerant in the refrigerant circuit (20); and outlet temperature control by adjusting the amount of throttling of the expansion mechanism (40) so that the aforesaid outlet refrigerant temperature is controlled to the target value.

In the third aspect of the present invention, the relationship between the high pressure refrigerant pressure of the refrigerant circuit (20) and the outlet refrigerant temperature of the heat dissipation side heat exchanger is determined by the inlet medium temperature of the heat dissipation side heat exchanger. Therefore, in the cooling operation mode, the target value for the high pressure refrigerant pressure of the refrigerant circuit (20) which target value provides an optimum COP is derived from the inlet medium temperature of the heat source side heat exchanger (21) and the outlet refrigerant temperature of the heat source side heat exchanger (21). And the amount of throttling of the expansion mechanism (40) is adjusted so that the high pressure refrigerant pressure of the refrigerant circuit (20) becomes the target value.

In addition, in the heating operation mode, the target value for the outlet refrigerant temperature of the utilization side heat exchanger (23) which target value provides an optimum COP is derived from the preset value for the high pressure refrigerant pressure and the inlet medium temperature of the utilization side heat exchanger (23). And, the amount of throttling of the expansion mechanism (40) is adjusted so that the outlet refrigerant temperature of the utilization side heat exchanger (23) becomes the target value.

The present invention provides, as a fourth aspect according to the aforesaid first aspect, a refrigeration system characterized in that the high pressure control means (61) includes a first control part (6*a*) for adjusting the amount of throttling of the high pressure side throttle mechanism (41, 42) for pressure control and a second control part (6*b*) for adjusting the amount of throttling of the low pressure side throttle mechanism (42, 41) so that the degree of outlet refrigerant superheat of either the heat source side heat exchanger (21) or the utilization side heat exchanger (23), whichever becomes a heat absorption side heat exchanger functioning as a heat absorption unit, becomes a predefined value.

In the fourth aspect of the present invention, the first control part (6*a*) provides high pressure control by adjusting the amount of throttling of the high pressure side throttle mechanism (41, 42) and the second control part (6*b*) provides superheat degree control by adjusting the amount of throttling of the low pressure side throttle mechanism (42, 41).

The present invention provides, as a fifth aspect according to the aforesaid second aspect, a refrigeration system characterized in that the outlet temperature control means (63) includes a first control part (6*c*) for adjusting the amount of throttling of the high pressure side throttle mechanism (42) for outlet temperature control and a second control part (6*d*) for adjusting the amount of throttling of the low pressure side throttle mechanism (41) so that the degree of outlet refrigerant superheat of the heat source side heat exchanger (21) becomes a predefined value.

In the fifth aspect of the present invention, the first control part (6*c*) provides outlet temperature control by adjusting the amount of throttling of the high pressure side throttle mechanism (42) and the second control part (6*d*) provides superheat degree control by adjusting the amount of throttling of the low pressure side throttle mechanism (41).

The present invention provides, as a sixth aspect according to the aforesaid third aspect, a refrigeration system characterized in that the high pressure control means (61) includes a first control part (6*a*) for adjusting the amount of throttling of the heat source side throttle mechanism (41) for high pressure control and a second control part (6*b*) for adjusting the amount of throttling of the utilization side throttle mechanism (42) so that the degree of outlet refrigerant superheat of the utilization side heat exchanger (23) becomes a predefined value. In addition, the outlet temperature control means (63) includes a first control part (6*c*) for adjusting the amount of throttling of the utilization side throttle mechanism (42) for outlet temperature control and a second control part (6*d*) for adjusting the amount of throttling of the heat source side throttle mechanism (41) so that the degree of outlet refrigerant superheat of the heat source side heat exchanger (21) becomes a predefined value.

In the sixth aspect of the present invention, the first control part (6*a*) of the high pressure control means (61) provides high pressure control by adjusting the amount of throttling of the heat source side throttle mechanism (41) and the second control part (6*b*) of the high pressure control means (61) provides superheat degree control by adjusting the amount of throttling of the utilization side throttle mechanism (42).

In addition, the first control part (6*c*) of the outlet temperature control means (63) provides outlet temperature control by adjusting the amount of throttling of the utilization side throttle mechanism (42) and the second control part (6*d*) of the outlet temperature control means (63) provides superheat degree control by adjusting the amount of throttling of the heat source side throttle mechanism (41).

The present invention provides, as a seventh aspect according to any one of the aforesaid first to third aspects, a refrigeration system characterized in that the refrigerant circuit (20) includes a gas-liquid separator (22) arranged between the two throttle mechanisms (41, 42) of the expansion mechanism (40) and an injection passageway (25) through which to direct gas refrigerant in the gas-liquid separator (22) to an intermediate pressure region of the compression mechanism (30).

In the seventh aspect of the present invention, the refrigerant is separated into liquid refrigerant and gas refrigerant in the gas-liquid separator (22) and the gas refrigerant is introduced through the injection passageway (25) into the intermediate pressure region of the compression mechanism (30).

The present invention provides, as an eighth aspect according to the aforesaid seventh aspect, a refrigeration system characterized in that the compression mechanism (30) includes a lower stage compressor (33) and a higher stage compressor (34), and that the injection passageway (25) is configured such that gas refrigerant is directed to the intermediate pressure region between the lower stage compressor (33) and the higher stage compressor (34).

In the eighth aspect of the present invention, the refrigerant is compressed in two stages, i.e., in the lower stage compressor (33) and in the higher sage compressor (34) and the gas refrigerant in the gas-liquid separator (22) is directed to the intermediate pressure region of this two-stage compression.

The present invention provides, as a ninth aspect according to the aforesaid first aspect, a refrigeration system characterized in that the high pressure control means (61) is so configured as to derive a target value for the pressure of high pressure refrigerant in the refrigerant circuit (20) from, in addition to the outlet refrigerant temperature of the heat dissipation side heat exchanger and the inlet medium temperature of the heat dissipation side heat exchanger, the saturated pressure corresponding to the temperature of refrigerant in either the heat source side heat exchanger (21) or the utilization side heat exchanger (23), whichever becomes a heat absorption side heat exchanger functioning as a heat absorption unit.

In the ninth aspect of the present invention, the more accurate target value for the high pressure refrigerant pressure of the refrigerant circuit (20) is derived from the outlet refrigerant temperature of the heat dissipation side heat exchanger, the inlet medium temperature of the heat dissipation side heat exchanger, and the saturated pressure corresponding to the temperature of refrigerant in the heat absorption side heat exchanger.

The present invention provides, as a tenth aspect according to the aforesaid third aspect, a refrigeration system characterized in that the high pressure control means (61) is so configured as to derive a target value for the pressure of high pressure refrigerant in the refrigerant circuit (20) from in addition to the outlet refrigerant temperature of the heat source side heat exchanger (21) and the inlet medium temperature of the heat source side heat exchanger (21), the saturated pressure corresponding to the temperature of refrigerant in the utilization side heat exchanger (23).

In the tenth aspect of the present invention, the more accurate target value for the high pressure refrigerant pressure of the refrigerant circuit (20) is derived from the outlet refrigerant temperature of the heat source side heat exchanger (21), the inlet medium temperature of the heat source side heat exchanger (21), and the saturated pressure corresponding to the temperature of refrigerant in the utilization side heat exchanger (23).

The present invention provides, as an eleventh aspect according to either the first aspect or the second aspect, a refrigeration system characterized in that there is provided a capacity control means (62) for providing, in response to a capacity increase or decrease signal outputted from a utilization side unit (1B) in which the utilization side heat exchanger (23) is housed, increase/decrease control of the operation capacity of the compression mechanism (30).

In the eleventh aspect of the present invention, the capacity control means (62) separately provides increase/decrease control of the operation capacity of the compression mechanism (30).

The present invention provides, as a twelfth aspect according to the aforesaid eleventh aspect, a refrigeration system characterized in that the utilization side unit (1B) is so configured as to output, based on the inlet medium temperature of the utilization side heat exchanger (23) and the preset temperature, a capacity increase or decrease signal.

In the twelfth aspect of the present invention, the operation capacity of the compression mechanism (30) is subjected to increase/decrease control based on the inlet medium temperature of the utilization side heat exchanger (23) and the preset temperature.

The present invention provides, as a thirteenth aspect according to the aforesaid third aspect, a refrigeration system characterized in that there is provided a capacity control means (62) for providing control of the operation capacity of the compression mechanism (30) so that in the cooling operation mode, the low pressure refrigerant pressure of the refrigerant circuit (20) becomes a preset pressure value, and for providing control of the operation capacity of the compression mechanism (30) so that in the heating operation mode, the high pressure refrigerant pressure of the refrigerant circuit (20) becomes a preset pressure value.

In the thirteenth aspect of the present invention, the capacity control means (62) separately provides control of the operation capacity of the compression mechanism (30) so that the pressure of refrigerant in the refrigerant circuit (20) becomes a preset pressure value.

The present invention provides, as a fourteenth aspect according to the aforesaid thirteenth aspect, a refrigeration system characterized in that the capacity control means (62) is configured such that: in response to a capacity increase signal outputted from a utilization side unit (1B) in which the utilization side heat exchanger (23) is housed, the preset pressure value for the pressure of low pressure refrigerant in the cooling operation mode is decreased while the preset pressure value for the pressure of high pressure refrigerant in the heating operation mode is increased, and in response to a capacity decrease signal outputted from the utilization side unit (1B), the preset pressure value for the pressure of low pressure refrigerant in the cooling operation mode is increased while the preset pressure value for the pressure of high pressure refrigerant in the heating operation mode is decreased.

In the fourteenth aspect of the present invention, the operation capacity of the compression mechanism (30) is subjected to increase/decrease control in response to the capacity increase and decrease signals provided from the utilization side unit (1B).

The present invention provides, as a fifteenth aspect according to the aforesaid fourteenth aspect, a refrigeration system characterized in that the utilization side throttle mechanism (42) is formed by an expansion valve variable in the degree of opening thereof, and that the utilization side unit (1B) is so configured as to output: a capacity increase signal if the degree of opening of the utilization side throttle mechanism (42) exceeds a predefined change value, and a capacity decrease signal if the degree of opening of the utilization side throttle mechanism (42) falls below the predefined change value.

The present invention provides, as a sixteenth aspect according to the aforesaid fifteenth aspect, a refrigeration system characterized in that the utilization side unit (1B) is configured such that: a capacity increase signal is outputted if the degree of opening of the utilization side throttle mechanism (42) exceeds 80-90 percent of the degree of full opening thereof, and a capacity decrease signal is outputted if the degree of opening of the utilization side throttle mechanism (42) falls below 10-20 percent of the degree of full opening thereof.

In each of the aforesaid fifteenth and sixteenth aspects of the present invention, the operation capacity of the compression mechanism (30) is subjected to increase/decrease control based on the degree of opening of the utilization side throttle mechanism (42).

The present invention provides, as a seventeenth aspect according to the aforesaid fourteenth aspect, a refrigeration system characterized in that the capacity control means (62) is configured such that the preset pressure value is modified: if the number of utilization side units (1B) that output a capacity increase signal reaches a predefined percentage, and if the number of utilization side units (1B) that output a capacity decrease signal reaches a predefined percentage.

The present invention provides, as an eighteenth aspect according to the aforesaid seventeenth aspect, a refrigeration system characterized in that the predefined percentage of the number of utilization side units (1B) at which the capacity control means (62) modifies the preset pressure value is set at 20-40 percent.

In the each of the seventeenth and eighteenth aspects of the present invention, the operation capacity of the compression mechanism (30) is increased or decreased if a predefined number of utilization side units (1B) output a capacity increase or decrease signal.

Advantageous Effects of the Invention

In accordance with the aforesaid first and third aspects of the invention, the target value for the pressure of high pressure refrigerant is derived from the inlet medium temperature of the heat dissipation side heat exchanger and the outlet refrigerant temperature of the heat dissipation side heat exchanger, and the amount of throttling of the expansion mechanism (40) is adjusted so that the aforesaid high pressure refrigerant pressure becomes the target value, thereby making it possible that the operation is carried out in an operation state in which the coefficient of performance (COP) is optimized.

In addition, in accordance with the aforesaid second and third aspects of the present invention, in the heating operation mode, the target value for the outlet refrigerant temperature of the utilization side heat exchanger (23) is derived from the preset pressure value for the high pressure refrigerant pressure of the refrigerant circuit (20) and the inlet medium temperature of the utilization side heat exchanger (23), and the amount of throttling of the second throttle mechanism (42) is adjusted so that the aforesaid outlet refrigerant temperature becomes the target value, thereby making it possible that the operation can be carried out in an operation state that provides an optimum coefficient of heating performance (COP).

Moreover, in accordance with the aforesaid fourth and sixth aspects of the present invention, one throttle mechanism (41, 42) provides high pressure control and the other throttle mechanism (42, 41) provides superheat degree control, thereby making it possible to maintain high pressure refrigerant and low pressure refrigerant in their respective optimum states.

In addition, in accordance with the aforesaid fifth and sixth aspects of the present invention, in the heating operation mode, one throttle mechanism (42) provides outlet temperature control and the other throttle mechanism (41) provides superheat degree control, thereby making it possible to maintain high pressure refrigerant and low pressure refrigerant in their respective optimum states.

In addition, in accordance with the aforesaid seventh aspect of the present invention, the gas refrigerant in the gas-liquid separator (22) is directed through the injection passageway (25) to the intermediate pressure region of the compression mechanism (30), thereby ensuring that the pressure of high pressure refrigerant can be adjusted without fail.

Moreover, in accordance with the aforesaid ninth aspect of the present invention, the target value for the pressure of high pressure refrigerant is derived from the outlet refrigerant temperature of the heat dissipation side heat exchanger, the inlet medium temperature of the heat dissipation side heat exchanger, and the saturated pressure corresponding to the temperature of refrigerant in the heat absorption side heat exchanger. This makes it possible that the target value for the pressure of high pressure refrigerant can be more accurately obtained.

In addition, in accordance with the aforesaid eleventh and thirteenth aspects of the present invention, the operation capacity of the compression mechanism (30) is controlled separately, thereby making it possible to ensure that the operation is maintained in an optimum operation state.

REFERENCE NUMERALS IN THE DRAWINGS

Figure 1:
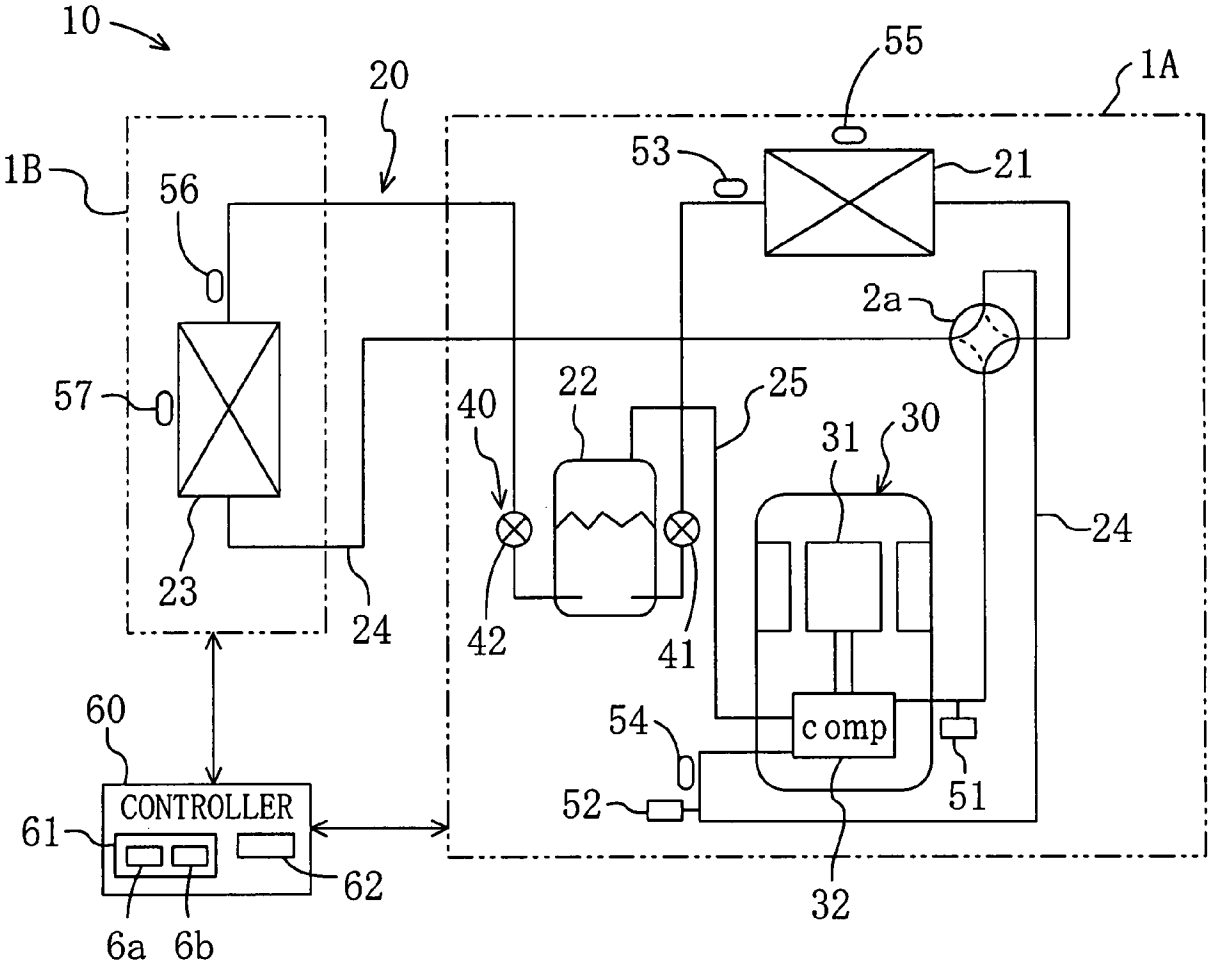
FIG. 1 is a refrigerant circuit diagram illustrating the configuration of a refrigeration system according to a first embodiment of the present invention.

10 air conditioner
20 refrigerant circuit
21 outdoor heat exchanger (heat source side heat exchanger)
22 gas-liquid separator
23 indoor heat exchanger (utilization side heat exchanger)
25 injection passageway
30 compression mechanism
32 compressor
33 lower stage compressor
34 higher stage compressor
40 expansion mechanism
41 first throttle mechanism
42 second throttle mechanism
60 controller
61 high pressure control part (high pressure control means)
62 capacity control part (capacity control means)
63 outlet temperature control part (outlet temperature control means)
6*a*, 6*c* first control part
6*b*, 6*d* second control part

BEST MODE FOR CARRYING OUT THE INVENTION

Hereinafter, with reference to the accompanying drawings, embodiments of the present invention will be described in detail.

First Embodiment of the Invention

Referring to FIG. 1, there is shown a refrigeration system of the present embodiment. This refrigeration system is configured as an air conditioner (10) which is selectively operable either in a cooling operation mode (room cooling operation) or in a heating operation mode (room heating operation). The air conditioner (10) is provided with a refrigerant circuit (20), and is in the form of a so-called "pair-type" air conditioner in which a single indoor unit (1B) is connected to an outdoor unit (1A).

The refrigerant circuit (20) is formed as a closed circuit in which a compression mechanism (30), a four-way selector valve (2*a*), an outdoor heat exchanger (21), a first throttle mechanism (41) which is a part of an expansion mechanism (40), a gas-liquid separator (22), a second throttle mechanism (42) which is another part of the expansion mechanism (40), and an indoor heat exchanger (23) are connected by a refrigerant line (24). The refrigerant circuit (20) is filled with, for example, carbon dioxide ($CO_2$) as a refrigerant, and is so configured as to perform a vapor compression supercritical refrigeration cycle which is a refrigeration cycle including a vapor pressure region above a critical temperature.

The outdoor unit (1A) houses the compression mechanism (30), the four-way selector valve (2*a*), the outdoor heat exchanger (21), the first throttle mechanism (41), the gas-liquid separator (22), and the second throttle mechanism (42). The outdoor unit (1A) constitutes a heat source side unit. On the other hand, the indoor unit (1B) houses the indoor heat exchanger (23) and constitutes a utilization side unit.

The compression mechanism (30) is configured such that its vertically elongated cylindrical casing houses therein an electric motor (31) and a single compressor (32) connected to the electric motor (31). The compressor (32) is formed, for example, by a rotary compressor of the swinging piston type.

The outdoor heat exchanger (21) constitutes a heat source side heat exchanger for the exchange of heat between the refrigerant and the outdoor air. On the other hand, the indoor heat exchanger (23) constitutes a utilization side heat exchanger for the exchange of heat between the refrigerant and the indoor air.

Furthermore, in the cooling operation mode, the outdoor heat exchanger (21) constitutes a heat dissipation side heat exchanger which functions as a heat dissipation unit in which the refrigerant discharged from the compression mechanism (30) dissipates heat to the outdoor air and the indoor heat exchanger (23) constitutes a heat absorption side heat exchanger which functions as a heat absorption unit in which the refrigerant, pressure-reduced in the expansion mechanism (40), evaporates to absorb heat from the indoor air.

On the other hand, in the heating operation mode, the indoor heat exchanger (23) constitutes a heat dissipation side heat exchanger which functions as a heat dissipation unit in which the refrigerant discharged from the compression mechanism (30) dissipates heat to the indoor air and the outdoor heat exchanger (21) constitutes a heat absorption side heat exchanger which functions as a heat absorption unit in which the refrigerant, pressure-reduced in the expansion mechanism (40), evaporates to absorb heat from the outdoor air.

The outdoor air and the indoor air each serve as a medium which exchanges heat with the refrigerant.

The four-way selector valve (2*a*) has four ports via which the discharge and suction sides of the compression mechanism (30) and the outdoor and indoor heat exchangers (21, 23) are connected by the refrigerant line (24). The four-way selector valve (2*a*) is selectively operable either in a cooling mode state (indicated by solid line in FIG. 1) or in a heating mode state (indicated by broken line in FIG. 1). When the four-way selector valve (2*a*) is in the cooling mode state, the discharge side of the compression mechanism (30) and the outdoor heat exchanger (21) fluidly communicate with each other and the indoor heat exchanger (23) and the suction side of the compression mechanism (30) fluidly communicate with each other. On the other hand, when the four-way selector valve (2*a*) is in the heating mode state, the discharge side of the compression mechanism (30) and the indoor heat exchanger (23) fluidly communicate with each other and the outdoor heat exchanger (21) and the suction side of the compression mechanism (30) fluidly communicate with each other.

The first throttle mechanism (41) and the second throttle mechanism (42) together constitute the expansion mechanism (40) and are each formed by a respective expansion valve variable in the degree of opening, in other words, these expansion valves are configured such that they are variable in the amount of throttling.

Furthermore, in the cooling operation mode, the first throttle mechanism (41) constitutes a high pressure side throttle mechanism and the second throttle mechanism (42) constitutes a low pressure side throttle mechanism. On the other hand, in the heating operation mode, the second throttle mechanism (42) constitutes a high pressure side throttle mechanism and the first throttle mechanism (41) constitutes a low pressure side throttle mechanism.

In addition, the first throttle mechanism (41) constitutes a heat source side throttle mechanism. And the second throttle mechanism (42) constitutes a utilization side throttle mechanism.

The gas-liquid separator (22) is arranged in the refrigerant line (24) between the first throttle mechanism (41) and the second throttle mechanism (42) and is configured such that it separates the refrigerant in the intermediate pressure state into gas refrigerant and liquid refrigerant. One end of an injection passageway (25) is connected to the gas-liquid separator (22). And the other end of the injection passageway (25) is connected to an intermediate pressure region of the compressor (32). The injection passageway (25) is configured such that gas refrigerant after separation in the gas-liquid separator (22) is directed to the intermediate pressure region of the compressor (32).

Various sensors are provided in the refrigerant circuit (20). More specifically, a high pressure sensor (51) for the detection of the pressure of high pressure refrigerant is arranged in the refrigerant line (24) on the discharge side of the compression mechanism (30). And a low pressure sensor (52) for the detection of the pressure of low pressure refrigerant is arranged in the refrigerant line (24) on the suction side of the compression mechanism (30).

A first refrigerant temperature sensor (53) is arranged in the refrigerant line (24) on the indoor heat exchanger's (23) side of the outdoor heat exchanger (21). And a second refrigerant temperature sensor (54) is arranged in the refrigerant line (24) on the suction side of the compression mechanism (30). In addition, an outside air temperature sensor (55) is arranged on the air suction side of the outdoor heat exchanger (21).

A third refrigerant temperature sensor (56) is arranged in the refrigerant line (24) on the outdoor heat exchanger's (21) side of the indoor heat exchanger (23). And a room temperature sensor (57) is arranged on the air suction side of the indoor heat exchanger (23).

To sum up, in the cooling operation mode, the first refrigerant temperature sensor (53) detects the temperature of refrigerant at the outlet of the outdoor heat exchanger (21) while in the heating operation mode it detects the temperature of refrigerant at the inlet of the outdoor heat exchanger (21). In the heating operation mode, the third refrigerant temperature sensor (56) detects the temperature of refrigerant at the outlet of the indoor heat exchanger (23) while in the heating operation mode, it detects the temperature of refrigerant at the inlet of the indoor heat exchanger (23).

The second refrigerant temperature sensor (54) detects the temperature of suction refrigerant into the compression mechanism (30). That is, in the cooling operation mode, the second refrigerant temperature sensor (54) detects the temperature of refrigerant at the outlet of the indoor heat exchanger (23) while in the heating operation mode, it detects the temperature of refrigerant at the outlet of the outdoor heat exchanger (21).

The outside air temperature sensor (55) detects the temperature of suction air into the outdoor heat exchanger (21). More specifically, the outside air temperature sensor (55) detects the temperature of outdoor air which is the inlet medium temperature of the outdoor heat exchanger (21), i.e., the temperature of outside air.

The room temperature sensor (57) detects the temperature of suction air into the indoor heat exchanger (23). More specifically, the room temperature sensor (57) detects the temperature of room air which is the inlet medium temperature of the indoor heat exchanger (23), i.e., the temperature of room air.

The air conditioner (10) is provided with a controller (60) for controlling the refrigerant circuit (20). Sensor signals provided from the sensors such as the high pressure sensor (51) et cetera are fed to the controller (60). The controller (60) has a high pressure control part (61) and a capacity control part (62).

The high pressure control part (61) constitutes a high pressure control means, and is made up of a first control part (6*a*) and a second control part (6*b*).

From i) the outlet refrigerant temperature of the outdoor heat exchanger (21) which becomes a heat dissipation unit in the cooling operation mode and ii) the temperature of outside air which is the suction air temperature (inlet medium temperature) of the outdoor heat exchanger (21), the first control part (6*a*) derives a target value for the high pressure refrigerant pressure of the refrigerant circuit (20). Then, the first control part (6*a*) provides high pressure control by adjusting the amount of throttling of the first throttle mechanism (41) which is a high pressure side throttle mechanism so that the high pressure refrigerant pressure of the refrigerant circuit (20) is controlled to the target value.

In addition, from i) the outlet refrigerant temperature of the indoor heat exchanger (23) which becomes a heat dissipation unit in the heating operation mode and ii) the temperature of room air which is the suction air temperature (inlet medium temperature) of the indoor heat exchanger (23), the first control part (6*a*) derives a target value for the high pressure refrigerant pressure of the refrigerant circuit (20). Then, the first control part (6*a*) provides high pressure control by adjusting the amount of throttling of the second throttle mechanism (42) which is a high pressure side throttle mechanism so that the high pressure refrigerant pressure of the refrigerant circuit (20) is controlled to the target value.

Based on i) the inlet refrigerant temperature of the indoor heat exchanger (23) which becomes a heat absorption unit in the cooling operation mode and ii) the outlet refrigerant temperature of the indoor heat exchanger (23), the second control part (6*b*) adjusts the amount of throttling of the second throttle mechanism (42) which is a low pressure side throttle mechanism so that the degree of superheat of refrigerant at the outlet of the indoor heat exchanger (23) is adjusted to a predefined value.

In addition, based on i) the inlet refrigerant temperature of the outdoor heat exchanger (21) which becomes a heat absorption unit in the heating operation mode and ii) the outlet refrigerant temperature of the outdoor heat exchanger (21), the second control part (6*b*) adjusts the amount of throttling of the first throttle mechanism (41) which is a low pressure side throttle mechanism so that the degree of superheat of refrigerant at the outlet of the outdoor heat exchanger (21) is adjusted to a predefined value.

The capacity control part (62) constitutes a capacity control means. The capacity control part (62) is configured such that, in response to a capacity increase or decrease signal outputted from the indoor unit (1B), it provides increase/decrease control of the operation capacity of the compressor (32). And the indoor unit (1B) is configured such that, based on i) the temperature of room air which is the temperature of suction air into the indoor heat exchanger (23) and ii) the preset temperature for the room air, it outputs a capacity increase signal or a capacity decrease signal.

Basic Principle for the High Pressure Control

Here, referring to FIGS. 4 through 9, the basic principle of the high pressure control provided by the first control part (6*a*) will be described. The following description is made in terms of the cooling operation mode.

Figure 4:
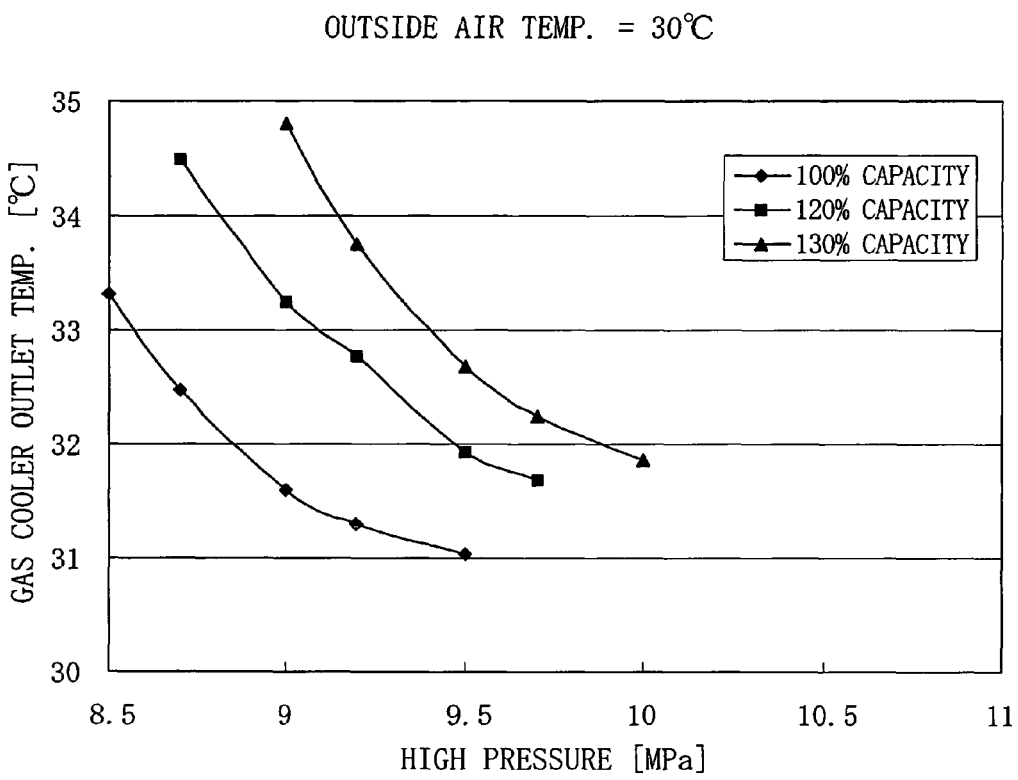
FIG. 4 is a characteristic curve diagram depicting the relationship between the high pressure refrigerant pressure and the outlet refrigerant temperature for each cooling capacity at an outside air temperature of 30° Centigrade.
Figure 5:
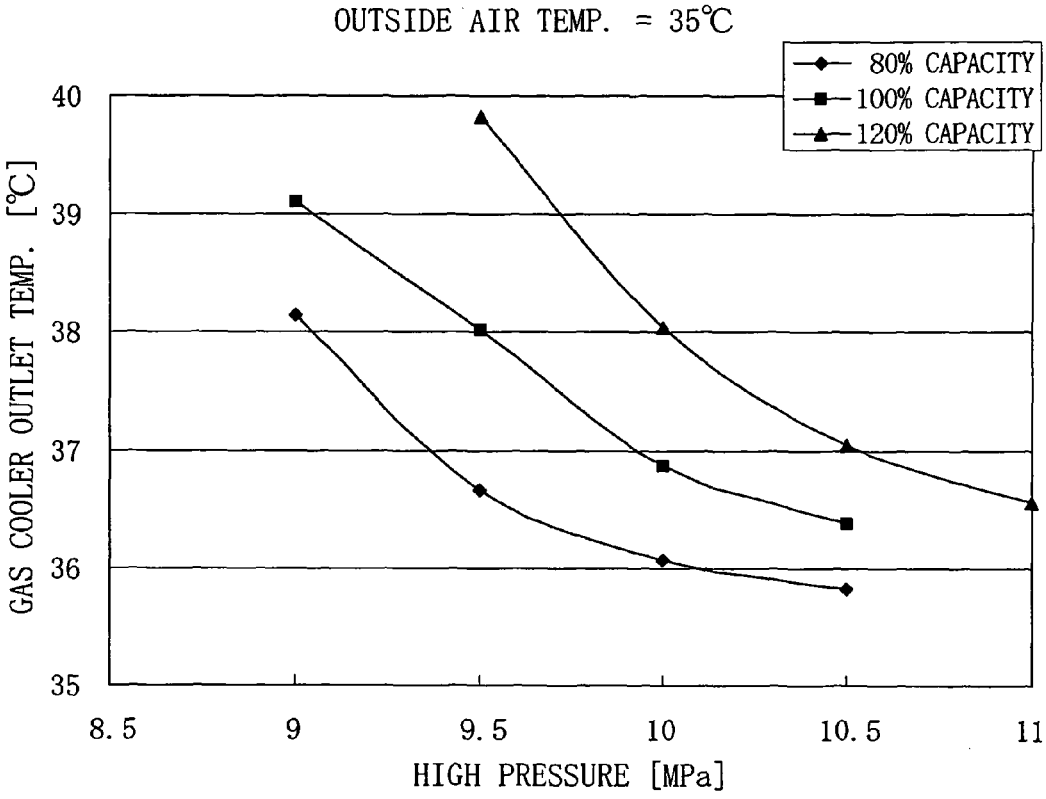
FIG. 5 is a characteristic curve diagram depicting the relationship between the high pressure refrigerant pressure and the outlet refrigerant temperature for each cooling capacity at an outside air temperature of 35° Centigrade.

In the case where carbon dioxide is used as a refrigerant, the refrigerant circuit (20) becomes a supercritical cycle. In this case, if the cooling capacity of the refrigerant circuit (20) is constant, then the outlet refrigerant temperature of the outdoor heat exchanger (21) which is a heat dissipation unit (gas cooler) drops when the high pressure refrigerant pressure of the refrigerant circuit (20) increases, as shown in FIGS. 4 and 5. That is, FIG. 4 shows the relationship between the high pressure refrigerant pressure and the outlet refrigerant temperature for each cooling capacity, when the temperature of outside air is 30° Centigrade. FIG. 5 shows the relationship between the high pressure refrigerant pressure and the outlet refrigerant temperature for each cooling capacity, when the temperature of outside air is 35° Centigrade.

It is therefore impossible to determine, based on the outlet refrigerant temperature of the outdoor heat exchanger (21), an optimum coefficient of performance (COP).

Figure 6:
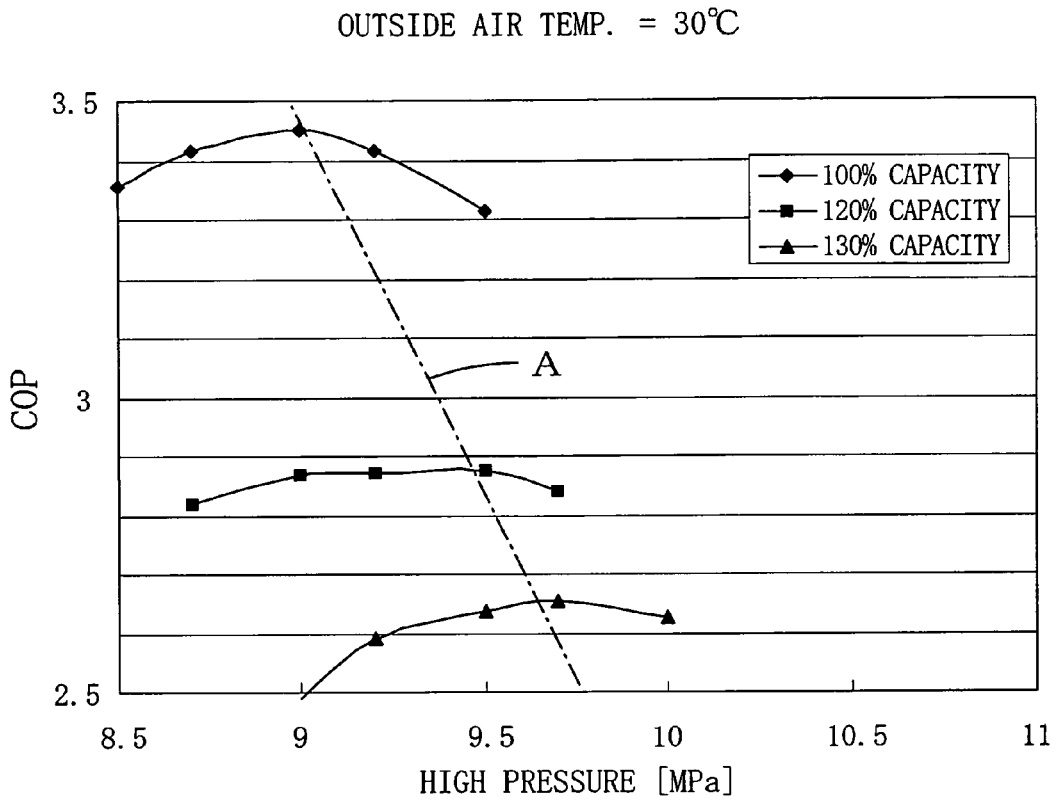
FIG. 6 is a characteristic curve diagram depicting the relationship between the high pressure refrigerant pressure and the coefficient of performance (COP) for each cooling capacity at an outside air temperature of 30° Centigrade.
Figure 7:
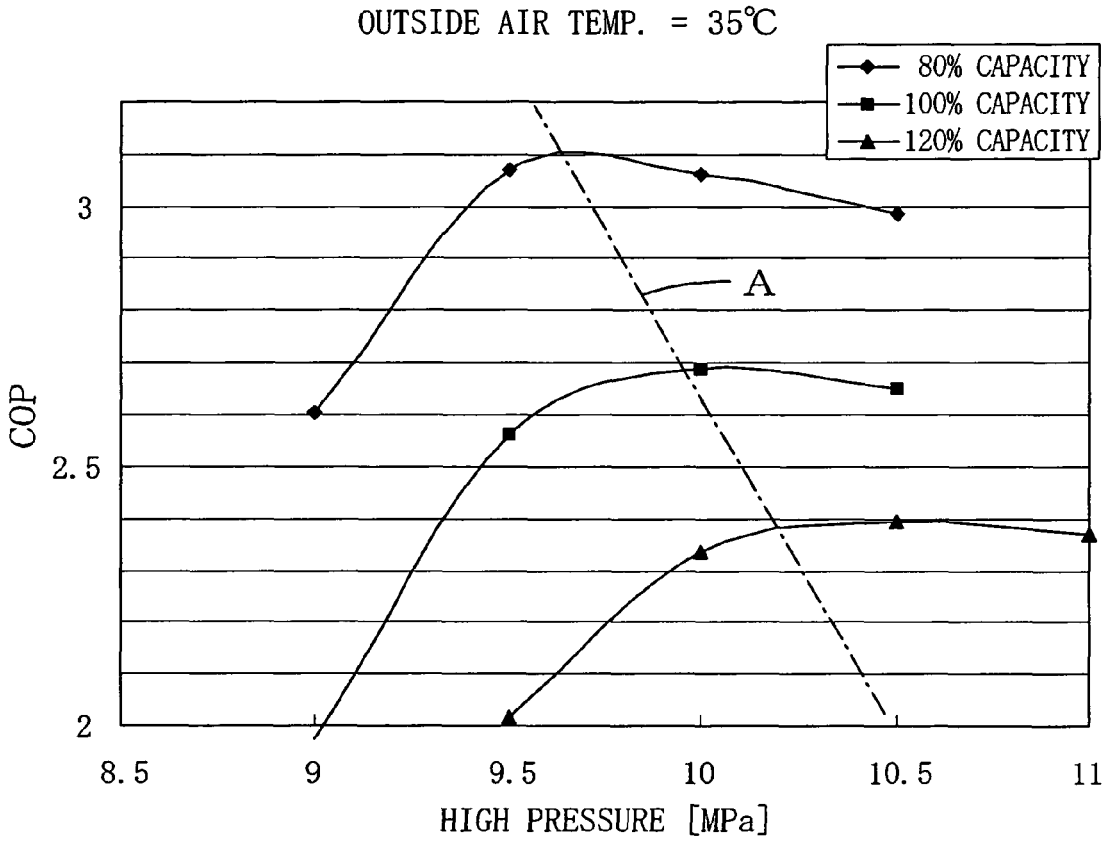
FIG. 7 is a characteristic curve diagram depicting the relationship between the high pressure refrigerant pressure and the coefficient of performance (COP) for each cooling capacity at an outside air temperature of 35° Centigrade.

More specifically, FIG. 6 shows the relationship between the high pressure refrigerant pressure and the coefficient of performance (COP) for each cooling capacity, when the temperature of outside air is 30° Centigrade. FIG. 7 shows the relationship between the high pressure refrigerant pressure and the coefficient of performance (COP) for each cooling capacity, when the temperature of outside air is 35° Centigrade. And the high pressure refrigerant pressure that achieves an optimum coefficient of performance (COP) is indicated by line "A".

Figure 8:
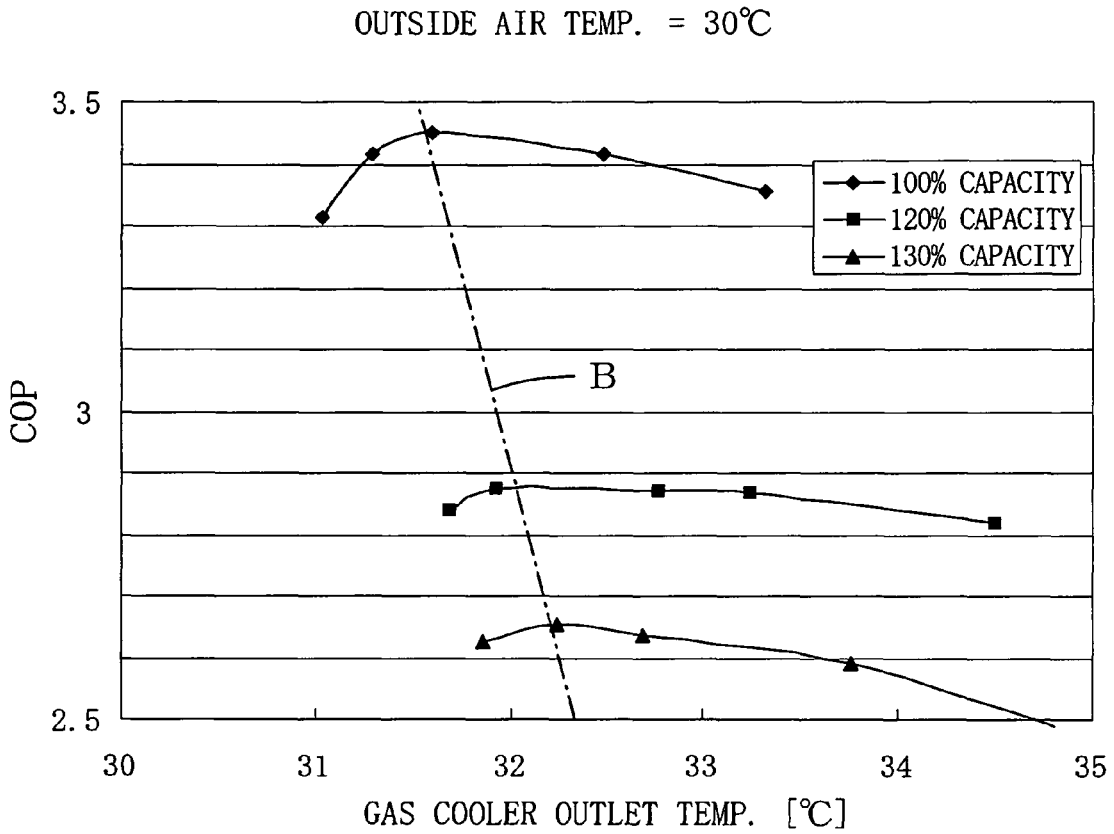
FIG. 8 is a characteristic curve diagram depicting the relationship between the outlet refrigerant temperature and the coefficient of performance (COP) for each cooling capacity at an outside air temperature of 30° Centigrade.
Figure 9:
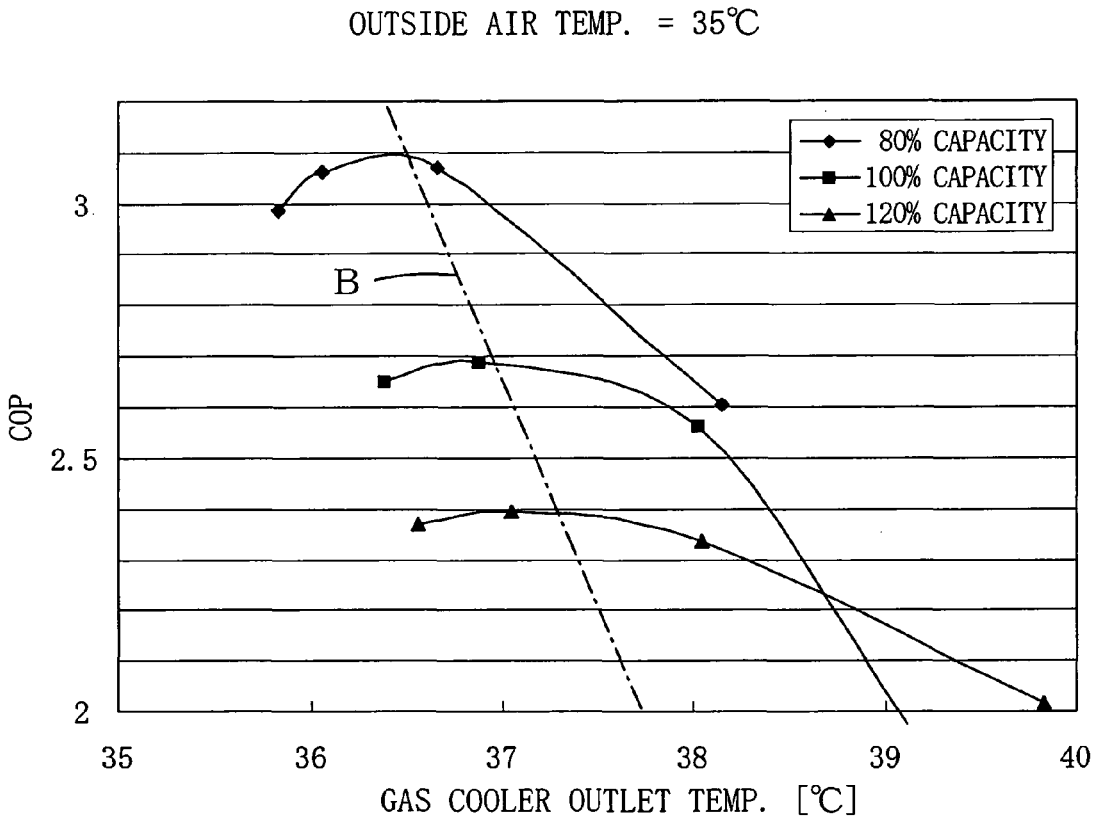
FIG. 9 is a characteristic curve diagram depicting the relationship between the outlet refrigerant temperature and the coefficient of performance (COP) for each cooling capacity at an outside air temperature of 35° Centigrade.
Figure 10:
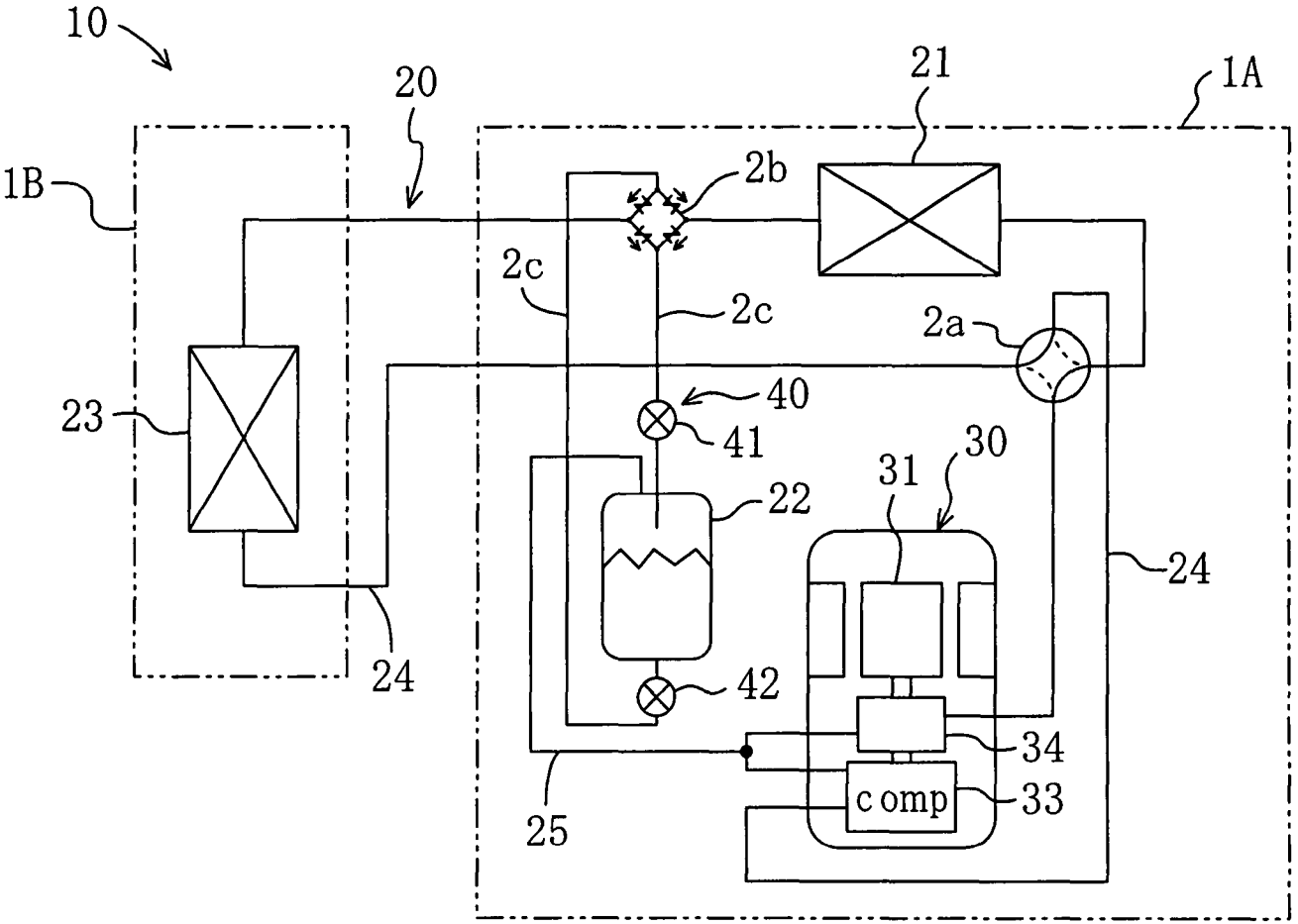
FIG. 10 is a refrigerant circuit diagram illustrating the configuration of a refrigeration system according to a second embodiment of the present invention.
Figure 11:
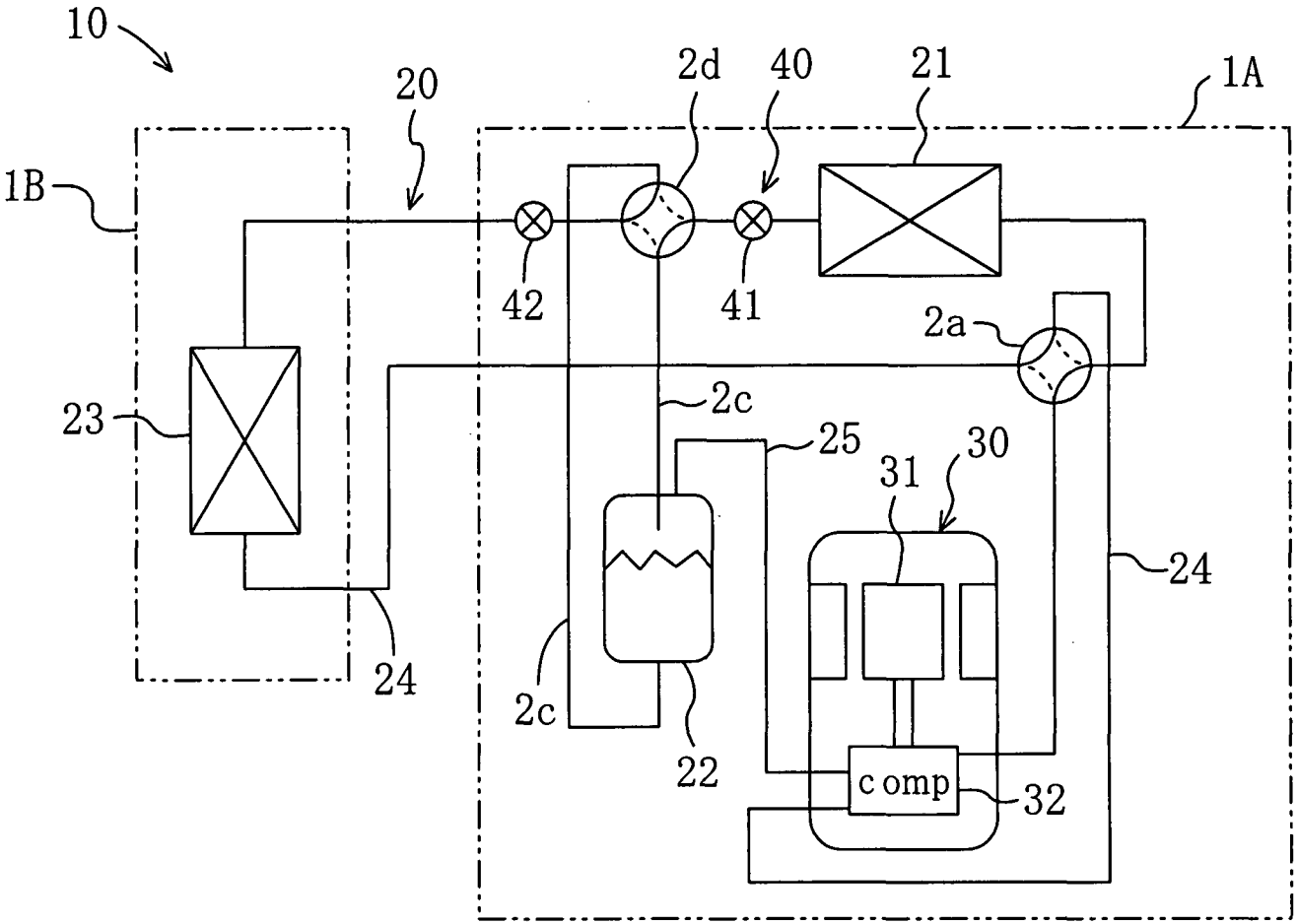
FIG. 11 is a refrigerant circuit diagram illustrating the configuration of a refrigeration system according to a third embodiment of the present invention.

In addition, FIG. 8 shows the relationship between the outlet refrigerant temperature and the coefficient of performance (COP) for each cooling capacity when the temperature of outside air is 30° Centigrade. FIG. 9 shows the relationship between the outlet refrigerant temperature and the coefficient of performance (COP) for each cooling capacity, when the temperature of outside air is 35° Centigrade. The outlet refrigerant temperature that achieves an optimum COP is represented by line "B".

As can be seen from FIGS. 4 through 9, even when the outside air temperature condition is the same, the high pressure refrigerant pressure and the outlet refrigerant temperature at which the coefficient of performance (COP) becomes optimum increase if the cooling capacity is boosted. However, the outlet refrigerant temperature is subjected to considerable variation if the temperature of outside air differs (see FIGS. 8 and 9). Stated another way, in spite of the difference in the outlet refrigerant temperature, the optimum high pressure refrigerant pressure (when the temperature of outside air is 30° Centigrade and the cooling capacity is 130%) and the optimum high pressure refrigerant (when the temperature of outside air is 35° Centigrade and the cooling capacity is 80%) are the same, i.e., 9.7 Mpa.

As described above, the relationship between the high pressure refrigerant pressure and the outlet refrigerant temperature is determined by the temperature of outside air. That is, it is necessary to determine, based on the temperature of outside air and the outlet refrigerant temperature, a target high pressure refrigerant pressure that provides an optimum coefficient of performance (COP). In other words, the optimum coefficient of performance (COP) is determined based on the temperature of outside air, the outlet refrigerant temperature, and the high pressure refrigerant pressure.

Therefore, in the present embodiment, the target value for the high pressure refrigerant pressure of the refrigerant circuit (20) which target value provides an optimum coefficient of performance (COP) is derived from i) the outside air temperature which is the temperature of suction air into the outdoor heat exchanger (21) and ii) the outlet refrigerant temperature of the outdoor heat exchanger (21). And, the degree of opening (the amount of throttling) of the first throttle mechanism (41) is adjusted so that the high pressure refrigerant pressure of the refrigerant circuit (20) becomes the target value.

Running Operation

Next, the following is a description of the running operation of the air conditioner (10).

In the cooling operation mode, the four-way selector valve (2*a*) changes state to the side indicated by solid line of FIG. 1. Refrigerant discharged from the compressor (32) dissipates heat to the outdoor air and as a result is cooled in the outdoor heat exchanger (21). Then, the refrigerant is pressure reduced by the first throttle mechanism (41) to enter an intermediate pressure state, and flows into the gas-liquid separator (22). In the gas-liquid separator (22), the refrigerant is separated into gas refrigerant and liquid refrigerant. The liquid refrigerant is pressure reduced by the second throttle mechanism (42), flows to the indoor heat exchanger (23), and is evaporated to gas refrigerant. This gas refrigerant is returned to the compressor (32) where it is again compressed. On the other hand, the gas refrigerant in the gas-liquid separator (22) is introduced into the intermediate pressure region of the compressor (32). This operation is repeatedly carried out thereby to provide room cooling.

In the heating operation mode, the four-way selector valve (2*a*) changes state to the side indicated by broken line of FIG. 1. Refrigerant discharged from the compressor (32) dissipates heat to the indoor air and as a result is cooled in the indoor heat exchanger (23). Then, the refrigerant is pressure reduced by the second throttle mechanism (42) to enter an intermediate pressure state, and flows into the gas-liquid separator (22). In the gas-liquid separator (22), the refrigerant is separated into gas refrigerant and liquid refrigerant. The liquid refrigerant is pressure reduced by the first throttle mechanism (41), flows to the outdoor heat exchanger (21), and is evaporated to gas refrigerant. This gas refrigerant is returned to the compressor (32) where it is again compressed. On the other hand, the gas refrigerant in the gas-liquid separator (22) is introduced into the intermediate pressure region of the compressor (32). This operation is repeatedly carried out thereby to provide room heating.

Next, with reference to the control flows respectively shown in FIGS. 2 and 3, the operation of the control of the first and second throttle mechanisms (41, 42) and the operation of the control of the operation capacity of the compression mechanism (30) will be described below.

Figure 2:
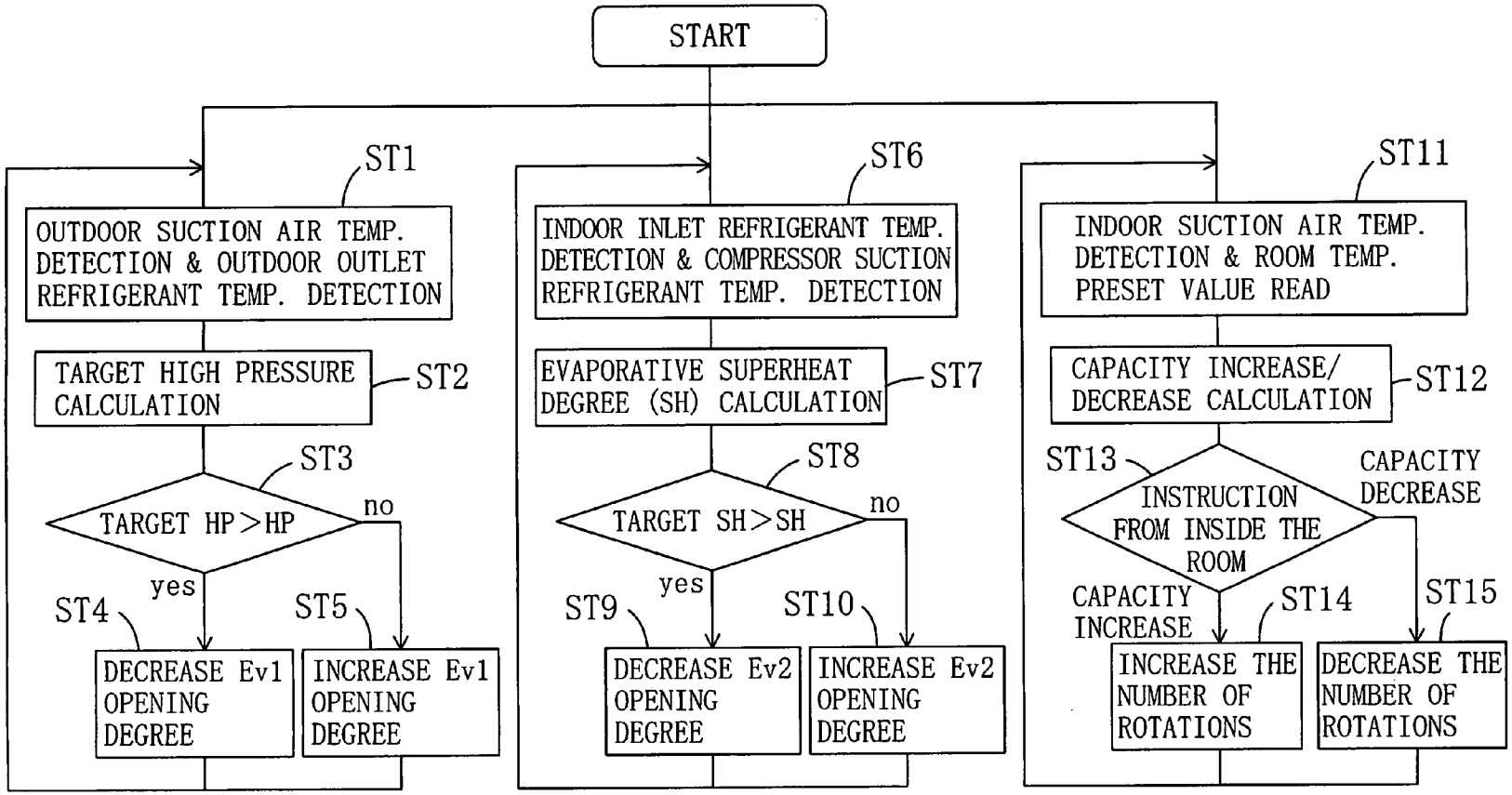
FIG. 2 is a control flow chart showing the control of the amount of throttling of a throttle mechanism and the control of the capacity of a compression mechanism in the cooling operation mode of the first embodiment.

In the cooling operation mode, as shown in FIG. 2, upon the start of the control flow, the outside air temperature sensor (55) detects the temperature of outside air which is the temperature of suction air into the outdoor heat exchanger (21) and the first refrigerant temperature sensor (53) detects the outlet refrigerant temperature of the outdoor heat exchanger (21) (step ST1). Subsequently, the control flow proceeds to step ST2, in which step the first control part (6*a*) derives, from the temperature of outside air and the outlet refrigerant temperature, a target value for the pressure of high pressure refrigerant.

Thereafter, the control flow proceeds to step ST3, in which step the first control part (6*a*) makes a decision of whether or not the high pressure refrigerant pressure detected by the high pressure sensor (51) exceeds the target value. If it is decided that the detected high pressure refrigerant pressure falls below the target value, then the control flow proceeds from step ST3 to step ST4. In step ST4, the degree of opening of the first throttle mechanism (41) is reduced, in other words, the amount of throttling thereof is increased. Then, the control flow returns to step ST1.

If it is decided that the detected pressure of high pressure refrigerant exceeds the target value, then the control flow proceeds from step ST3 to step ST5. In step ST5, the degree of opening of the first throttle mechanism (41) is increased, in other words, the amount of throttling thereof is reduced. Then, the control flow returns to step ST1. This operation is repeatedly carried out thereby to adjust the degree of opening of the first throttle mechanism (41).

Meanwhile, in step ST6, the third refrigerant temperature sensor (56) detects the inlet refrigerant temperature of the indoor heat exchanger (23) and the second refrigerant temperature sensor (54) detects the outlet refrigerant temperature of the indoor heat exchanger (23), in other words, the temperature of suction refrigerant into the compression mechanism (30) is detected. Subsequently, the control flow proceeds to step ST7, in which step the second control part (6*b*) derives, from the detected inlet refrigerant temperature and the detected outlet refrigerant temperature, the degree of superheat of refrigerant at the outlet of the indoor heat exchanger (23) which is the degree of vapor superheat.

Thereafter, the control flow proceeds to step ST8, in which step the second control part (6*b*) makes a decision of whether or not the derived degree of superheat exceeds a predefined value which is a target degree of superheat. If it is decided that the derived degree of superheat falls below the predefined value, then the control flow proceeds from step ST8 to step ST9. In step ST9, the degree of opening of the second throttle mechanism (42) is reduced, in other words, the amount of throttling thereof is increased. Then, the control flow returns to step ST6.

If it is decided that the derived degree of superheat exceeds the predefined value, then the control flow proceeds from step ST8 to step ST10. In step ST10, the degree of opening of the second throttle mechanism (42) is increased, in other words, the amount of throttling thereof is reduced. Then, the control flow returns to step ST6. This operation is repeatedly carried out thereby to adjust the degree of opening of the second throttle mechanism (42).

Additionally, in step ST11, the room temperature sensor (57) detects the temperature of room air (room temperature) which is the temperature of suction air into the indoor heat exchanger (23) and, in addition, reads a preset temperature value for the room temperature. Subsequently, the control flow proceeds to step ST12, in which step the indoor unit (1B) outputs a capacity increase signal if the detected room temperature exceeds the preset temperature value. On the other hand, the indoor unit (1B) outputs a capacity decrease signal if the detected room temperature falls below the preset temperature value.

Thereafter, the control flow proceeds to step ST13, in which step the capacity control part (62) makes a decision of whether the output provided from the indoor unit (1B) is a capacity increase signal or a capacity decrease signal. If the output of the indoor unit (1B) is a capacity increase signal, then the control flow proceeds from step ST13 to step ST14. In step ST14, the operation capacity of the compression mechanism (30) is boosted, in other words, the number of rotations of the compressor (32) is increased. Then, the control flow returns to step ST11.

If the output of the indoor unit (1B) is a capacity decrease signal, then the control flow proceeds from step ST13 to step ST15. In step ST15, the operation capacity of the compression mechanism (30) is lowered, in other words, the number of rotations of the compressor (32) is reduced. Then, the control flow returns to step ST11. This operation is repeatedly carried out thereby to adjust the operation capacity of the compression mechanism (30).

Figure 3:
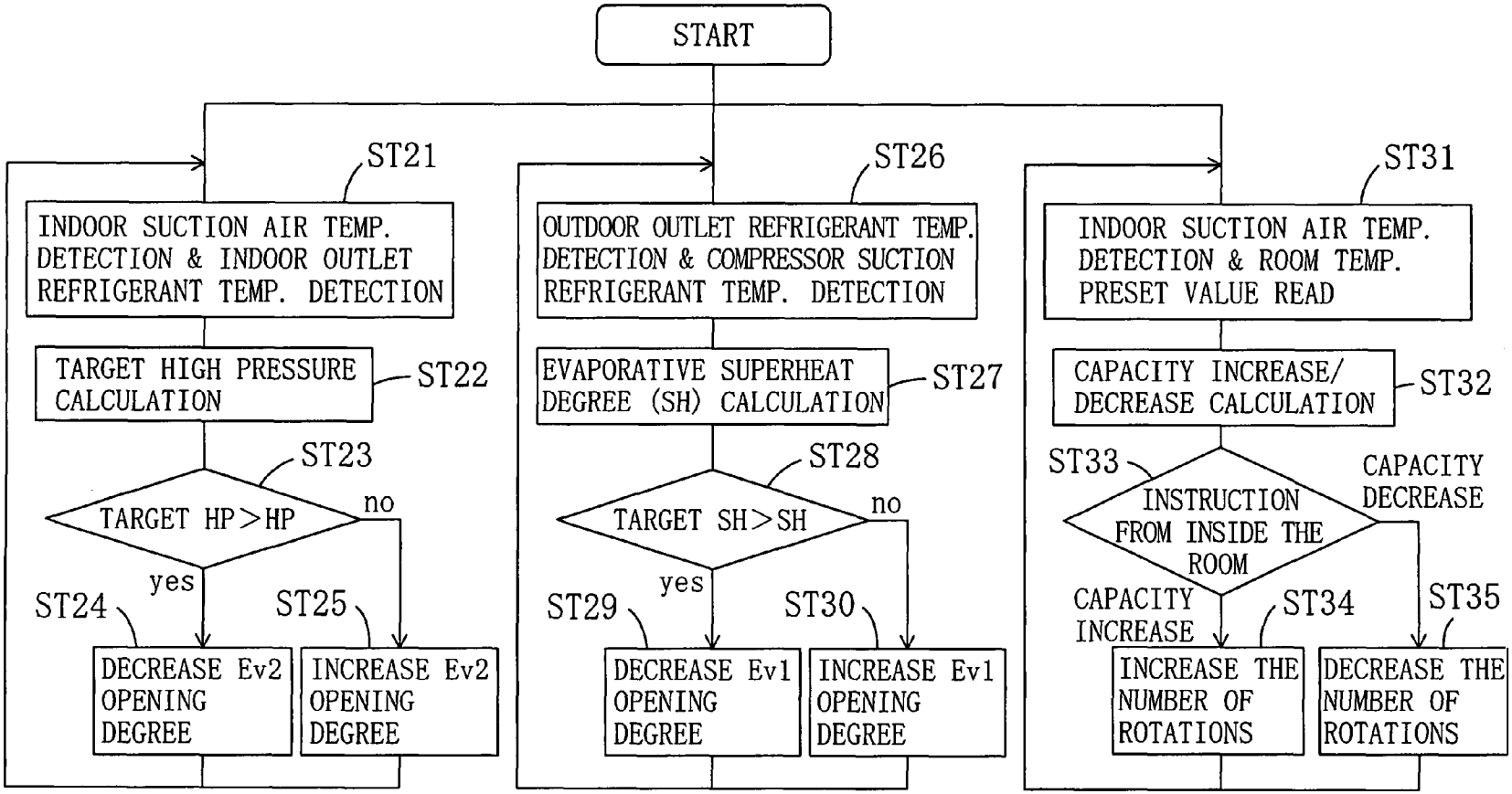
FIG. 3 is a control flow chart showing the control of the amount of throttling of a throttle mechanism and the control of the capacity of a compression mechanism in the heating operation mode of the first embodiment.

In the heating operation mode, as shown in FIG. 3, upon the start of the control flow, the room temperature sensor (57) detects the room temperature, i.e., the temperature of suction air into the indoor heat exchanger (23) and, in addition, the third refrigerant temperature sensor (56) detects the outlet refrigerant temperature of the indoor heat exchanger (23) (step ST21). Subsequently, the control flow proceeds to step ST22, in which step the first control part (6*a*) derives, from the room temperature and the outlet refrigerant temperature, a target value for the pressure of high pressure refrigerant.

Thereafter, the control flow proceeds to step ST23, in which step the first control part (6*a*) makes a decision of whether or not the high pressure refrigerant pressure detected by the high pressure sensor (51) exceeds the target value. If it is decided that the detected high pressure refrigerant pressure falls below the target value, then the control flow proceeds from step ST23 to step ST24. In step ST24, the degree of opening of the second throttle mechanism (42) is reduced, in other words, the amount of throttling thereof is increased. Then, the control flow returns to step ST21.

If it is decided that the detected high pressure refrigerant pressure exceeds the target value, then the control flow proceeds from step ST23 to step ST25. In step ST25, the degree of opening of the second throttle mechanism (42) is increased, in other words, the amount of throttling thereof is reduced. Then, the control flow returns to step ST21. This operation is repeatedly carried out thereby to adjust the degree of opening of the second throttle mechanism (42).

Meanwhile, in step ST26, the first refrigerant temperature sensor (53) detects the inlet refrigerant temperature of the outdoor heat exchanger (21) and, in addition, the second refrigerant temperature sensor (54) detects the outlet refrigerant temperature of the outdoor heat exchanger (21), in other words, the temperature of suction refrigerant into the compression mechanism (30) is detected. Subsequently, the control flow proceeds to step ST27, in which step the second control part (6*b*) derives, from the detected inlet refrigerant temperature and the detected suction refrigerant temperature, the degree of superheat of refrigerant at the outlet of the outdoor heat exchanger (21) which is the degree of vapor superheat.

Thereafter, the control flow proceeds to step ST28, in which step the second control part (6*b*) makes a decision of whether or not the derived degree of superheat exceeds a predefined value which is a target value for the degree of superheat. If it is decided that the derived degree of superheat falls below the predefined value, then the control flow proceeds from step ST28 to step ST29. In step ST29, the degree of opening of the first throttle mechanism (41) is reduced, in other words, the amount of throttling thereof is increased. Then, the control flow returns to step ST26.

If it is decided that the derived degree of superheat exceeds the predefined value, then the control flow proceeds from step ST28 to step ST30. In step ST30, the degree of opening of the first throttle mechanism (41) is increased, in other words, the amount of throttling thereof is reduced. Then, the control flow returns to step ST26. This operation is repeatedly carried out thereby to adjust the degree of opening of the first throttle mechanism (41).

Additionally, in step ST31, the room temperature sensor (57) detects the temperature of room air which is the temperature of suction air into the indoor heat exchanger (23) and, in addition, reads a preset temperature value for the room temperature. Subsequently, the control flow proceeds to step ST32, in which step the indoor unit (1B) outputs a capacity increase signal if the detected room temperature falls below the preset temperature value. On the other hand, the indoor unit (1B) outputs a capacity decrease signal if the detected room temperature exceeds the preset temperature value.

Thereafter, the control flow proceeds to step ST33, in which step the capacity control part (62) makes a decision of whether the output provided from the indoor unit (1B) is a capacity increase signal or a capacity decrease signal. If the output provided from the indoor unit (1B) is a capacity increase signal, then the control flow proceeds from step ST33 to step ST34. In step ST34, the operation capacity of the compression mechanism (30) is boosted, in other words, the number of rotations of the compressor (32) is increased. Then, the control flow returns to step ST31.

If the output provided from the indoor unit (1B) is a capacity decrease signal, then the control flow proceeds from step ST33 to step ST35. In step ST35, the operation capacity of the compression mechanism (30) is lowered, in other words, the number of rotations of the compressor (32) is reduced. Then, the control flow returns to step ST31. This operation is repeatedly carried out thereby to adjust the operation capacity of the compression mechanism (30).

Advantageous Effects of the First Embodiment

As described above, in the present embodiment, the target value for the pressure of high pressure refrigerant is derived from the temperature of suction air into the outdoor heat exchanger (21) (the temperature of outside air) and the outlet refrigerant temperature of the outdoor heat exchanger (21), in the cooling operation mode. In addition, the target value for the pressure of high pressure refrigerant is derived from the temperature of suction air into the indoor heat exchanger (23) (the temperature of room air) and the outlet refrigerant temperature of the indoor heat exchanger (23), in the heating operation mode. And the amount of throttling of the expansion mechanism (40) is adjusted so that the high pressure refrigerant pressure becomes the target value, thereby making it possible that the operation is carried out in an operation state in which the coefficient of performance (COP) is optimized.

In addition, in the cooling operation mode, the first throttle mechanism (41) provides high pressure control and the second throttle mechanism (42) provides superheat degree control while, on the other hand, in the heating operation mode, the second throttle mechanism (42) provides high pressure control and the first throttle mechanism (41) provides superheat degree control, thereby making it possible to maintain high pressure refrigerant and low pressure refrigerant in their respective optimum states.

In addition, the gas refrigerant in the gas-liquid separator (22) is directed through the injection passageway (25) to the intermediate pressure region of the compression mechanism (30), thereby making it possible to ensure that the pressure of high pressure refrigerant is adjusted without fail.

The operation capacity of the compression mechanism (30) is controlled separately, thereby making it possible to ensure that the operation is maintained in an optimum operation state.

Second Embodiment of the Invention

Next, a second embodiment of the present invention will be described in detail with reference to the drawings.

Unlike the first embodiment in which the refrigerant flows bi-directionally through the expansion mechanism (40) and the gas-liquid separator (22), in the present embodiment the refrigerant constantly flows through the expansion mechanism (40) and the gas-liquid separator (22) in one direction only.

More specifically, the refrigerant circuit (20) includes a flow rectification circuit (2*b*). The flow rectification circuit (2*b*) is formed into a bridge circuit which is provided with four flow passageways each having a respective one-way valve. And a first connection point of the flow rectification circuit (2*b*) is connected to the outdoor heat exchanger (21) and a second connection point thereof is connected to the indoor heat exchanger (23). Furthermore, a one-way passageway (2*c*) is connected to between a third an a fourth connection point of the flow rectification circuit (2*b*). The first throttle mechanism (41), the gas-liquid separator (22), and the second throttle mechanism (42) are connected, sequentially in that order from the upstream side, to the one-way passageway (2*c*).

Therefore, in any one of the cooling operation mode and the heating operation mode, from the first throttle mechanism (41), the refrigerant flows through the second throttle mechanism (42) by way of the gas-liquid separator (22).

The upstream side of the one-way passageway (2*c*) is connected to the top of the gas-liquid separator (22) and the downstream side of the one-way passageway (2*c*) is connected to the bottom of the gas-liquid separator (22).

As a result, the first throttle mechanism (41) always constitutes a high pressure side throttle mechanism and the second throttle mechanism (42) always constitutes a low pressure side throttle mechanism.

In addition, in any one of the cooling operation mode and the heating operation mode, the first control part (6*a*) of the high pressure control part (61) provides high pressure control by adjusting the amount of throttling of the first throttle mechanism (41) which is a high pressure side throttle mechanism so that the high pressure refrigerant pressure of the refrigerant circuit (20) is controlled to a target value.

In any one of the cooling operation mode and the heating operation mode, the second control part (6*b*) of the high pressure control part (61) adjusts the amount of throttling of the second throttle mechanism (42) which is a low pressure side throttle mechanism so that the degree of refrigerant superheat becomes a predefined value.

In addition, the compression mechanism (30) is provided with a lower stage compressor (33) and a higher stage compressor (34). And the injection passageway (25) is connected to between the lower stage compressor (33) and the higher stage compressor (34). Other configurations and operation/working-effects are the same as in the first embodiment.

Third Embodiment of the Invention

Next, a third embodiment of the present invention will be described in detail with reference to the drawings.

Unlike the first embodiment in which the refrigerant flows bi-directionally through the gas-liquid separator (22), in the present embodiment the refrigerant constantly flows through the gas-liquid separator (22) in one direction only.

More specifically, the refrigerant circuit (20) is provided with a switching mechanism (2*d*) for the switching of the flow of refrigerant. The switching mechanism (2*d*) is implemented by a four-way selector valve having four ports, two of which are connected through the first throttle mechanism (41) to the outdoor heat exchanger (21) and another two of which are connected through the second throttle mechanism (42) to the indoor heat exchanger (23).

Furthermore, the one-way passageway (2*c*) is connected to between the other two ports of the switching mechanism (2*d*). The one-way passageway (2*c*) is provided with the gas-liquid separator (22). The upstream side of the one-way passageway (2*c*) is connected to the top of the gas-liquid separator (22) and the downstream side of the one-way passageway (2*c*) is connected to the bottom of the gas-liquid separator (22).

Accordingly, in any one of the cooling operation mode and the heating operation mode, the refrigerant flows through the gas-liquid separator (22) in one direction only. Other configurations and operation/working effects are the same as in the first embodiment.

Fourth Embodiment of the Invention

Next, a fourth embodiment of the present invention will be described in detail with reference to the drawings.

Figure 12:
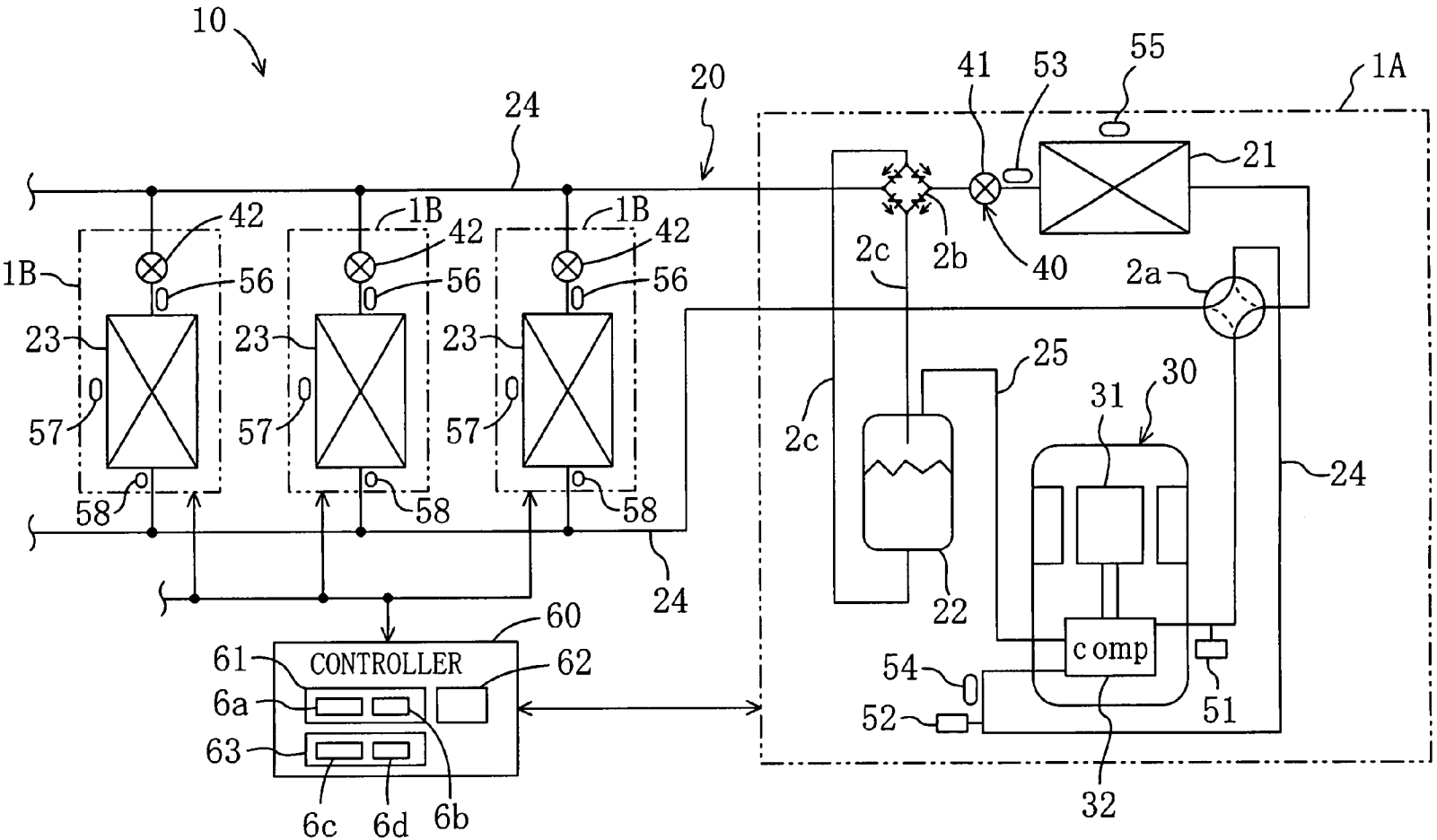
FIG. 12 is a refrigerant circuit diagram illustrating the configuration of a refrigeration system according to a fourth embodiment of the present invention.

Unlike the aforesaid first to third embodiments in which there is provided a single indoor unit (1B), the present embodiment is provided with a plurality of indoor units (1B), i.e., a so-called "multi-type", as shown in FIG. 12. In addition, the present embodiment is provided with the flow rectification circuit (2*b*) of the second embodiment and a plurality of indoor heat exchangers (23) are arranged in the refrigerant circuit (20).

More specifically, the plurality of indoor heat exchangers (23) are connected in parallel with each other. And each indoor heat exchanger (23) is connected to the outdoor unit (1A). Each indoor unit (1B) houses an indoor heat exchanger (23) and a second throttle mechanism (42) connected in series to the indoor heat exchanger (23).

In the outdoor unit (1A), the first throttle mechanism (41) is disposed in the refrigerant line (24) between the outdoor heat exchanger (21) and the flow rectification circuit (2*b*).

Similar to the first embodiment, the first throttle mechanism (41) is a heat source side throttle mechanism and the second throttle mechanism (42) is a utilization side throttle mechanism. In the cooling operation mode, the first throttle mechanism (41) constitutes a high pressure side throttle mechanism and the second throttle mechanism (42) constitutes a low pressure side throttle mechanism. On the other hand, in the heating operation mode, the second throttle mechanism (42) constitutes a high pressure side throttle mechanism and the first throttle mechanism (41) constitutes a low pressure side throttle mechanism.

As in the case of the first embodiment, the third refrigerant temperature sensor (56) and the room temperature sensor (57) are arranged in each indoor unit (1B). In addition, a fourth refrigerant temperature sensor (58) is arranged in the refrigerant line (24) on the compression mechanism's (30) side of the indoor heat exchanger (23). The fourth refrigerant temperature sensor (58) detects the temperature of refrigerant at the outlet of the indoor heat exchanger (23) in the heating operation mode.

On the other hand, in the controller (60) of the air conditioner (10), an outlet temperature control part (63) is provided in addition to the high pressure control part (61) and the capacity control part (62).

In the cooling operation mode, the high pressure control part (61) provides high pressure control and superheat degree control, as in the case of the first embodiment.

The outlet temperature control part (63) constitutes an outlet temperature control means and has a first control part (6*c*) and a second control part (6*d*).

From i) the temperature of room air which is the temperature of suction air into the indoor heat exchanger (23) which becomes a heat dissipation unit in the heating operation mode and ii) the preset pressure value for the high pressure refrigerant pressure of the refrigerant circuit (20), the first control part (6*c*) derives a target value for the outlet refrigerant temperature of the indoor heat exchanger (23) and provides outlet temperature control by adjusting the amount of throttling of the second throttle mechanism (42) which is a high pressure side throttle mechanism so that the outlet refrigerant temperature of the indoor heat exchanger (23) is controlled to the target value.

Based on i) the inlet refrigerant temperature of the outdoor heat exchanger (21) which becomes a heat absorption unit in the heating operation mode and ii) the outlet refrigerant temperature of the outdoor heat exchanger (21), the second control part (6*d*) adjusts the amount of throttling of the first throttle mechanism (41) which is a low pressure side throttle mechanism so that the degree of refrigerant superheat at the outlet of the outdoor heat exchanger (21) becomes a predefined value.

That is, as described in the first embodiment, the optimum coefficient of performance (COP) is determined by the temperature of room air (the temperature of outside air described in the first embodiment), the outlet refrigerant temperature, and the high pressure refrigerant pressure. Therefore, from i) the temperature of room air which is the temperature of suction air into the indoor heat exchanger (23) and ii) the preset pressure value for the high pressure refrigerant pressure of the refrigerant circuit (20), the first control part (6*c*) derives a target value for the outlet refrigerant temperature of the indoor heat exchanger (23) which target value provides an optimum coefficient of performance (COP). And, the degree of opening or the amount of throttling of the second throttle mechanism (42) is adjusted so that the outlet refrigerant temperature of the indoor heat exchanger (23) becomes the target value.

The capacity control part (62) constitutes a capacity control means. The capacity control part (62) provides control of the operation capacity of the compression mechanism (30) so that in the cooling operation mode, the low pressure refrigerant pressure of the refrigerant circuit (20) becomes a preset pressure value while in the heating operation mode the capacity control part (62) provides control of the operation capacity of the compression mechanism (30) so that the high pressure refrigerant pressure of the refrigerant circuit (20) becomes a preset pressure value.

In addition, in response to the capacity increase signal outputted from the indoor unit (1B), the capacity control part (62) decreases the preset pressure value for the low pressure refrigerant pressure in the cooling operation mode while the capacity control part (62) increases the preset pressure value for the high pressure refrigerant pressure in the heating operation mode. Additionally, in response to the capacity decrease signal outputted from the indoor unit (1B), the capacity control part (62) increases the preset pressure value for the low pressure refrigerant pressure in the cooling operation mode while the capacity control part (62) decreases the preset pressure value for the high pressure refrigerant pressure in the heating operation mode.

In addition, the capacity control part (62) modifies the preset pressure value if the percentage of the number of indoor units (1B) that output a capacity increase signal reaches 20 to 40 percent. In addition, the capacity control part (62) modifies the preset pressure value if the percentage of the number of indoor units (1B) that output a capacity decrease signal reaches 20-40 percent.

On the other hand, each indoor unit (1B) outputs a capacity increase signal if the degree of opening of the second throttle mechanism (42) exceeds 80-90 percent of the degree of full opening of the second throttle mechanism (42). In addition, each indoor unit (1B) outputs a capacity decrease signal if the degree of opening of the second throttle mechanism (42) falls below 80-90 percent of the degree of full opening of the second throttle mechanism (42). Other configurations are the same as in the case of the first embodiment.

Running Operation

The following is a description of the running operation of the air conditioner (10).

In the cooling operation mode, the four-way selector valve (2*a*) changes state to the side indicated by solid line of FIG. 12. And refrigerant discharged from the compressor (32) dissipates heat to the outdoor air and is cooled in the outdoor heat exchanger (21). Then, the refrigerant is pressure reduced in the first throttle mechanism (41) to enter an intermediate pressure state and flows into the gas-liquid separator (22). In the gas-liquid separator (22), the refrigerant is separated into gas refrigerant and liquid refrigerant. Thereafter, the liquid refrigerant flows to each indoor unit (1B), is pressure reduced in the second throttle mechanism (42), and evaporates to gas refrigerant in the indoor heat exchanger (23). This gas refrigerant is returned to the compressor (32) where it is compressed again. On the other hand, the gas refrigerant in the gas-liquid separator (22) is introduced into the intermediate pressure region of the compressor (32). This operation is repeatedly carried out thereby to provide room cooling.

In the heating operation mode, the four-way selector valve (2*a*) changes state to the side indicated by broken line of FIG. 12. And refrigerant discharged from the compressor (32) flows to each indoor unit (1B), dissipates heat to the indoor air and is cooled in the indoor heat exchanger (23). Then, the refrigerant is pressure reduced in the second throttle mechanism (42) to enter an intermediate pressure state and flows into the gas-liquid separator (22). In the gas-liquid separator (22), the refrigerant is separated into gas refrigerant and liquid refrigerant. The liquid refrigerant is pressure reduced in the first throttle mechanism (41), flows to the outdoor heat exchanger (21), and evaporates to gas refrigerant. This gas refrigerant is returned to the compressor (32) where it is compressed again. On the other hand, the gas refrigerant in the gas-liquid separator (22) is introduced into the intermediate pressure region of the compressor (32). This operation is repeatedly carried out thereby to provide room heating.

Now, with reference to the control flow charts respectively shown in FIGS. 13 and 14, the operation of the control of the first and second throttle mechanisms (41, 42) and the operation of the control of the operation capacity of the compression mechanism (30) will be described.

Figure 13:
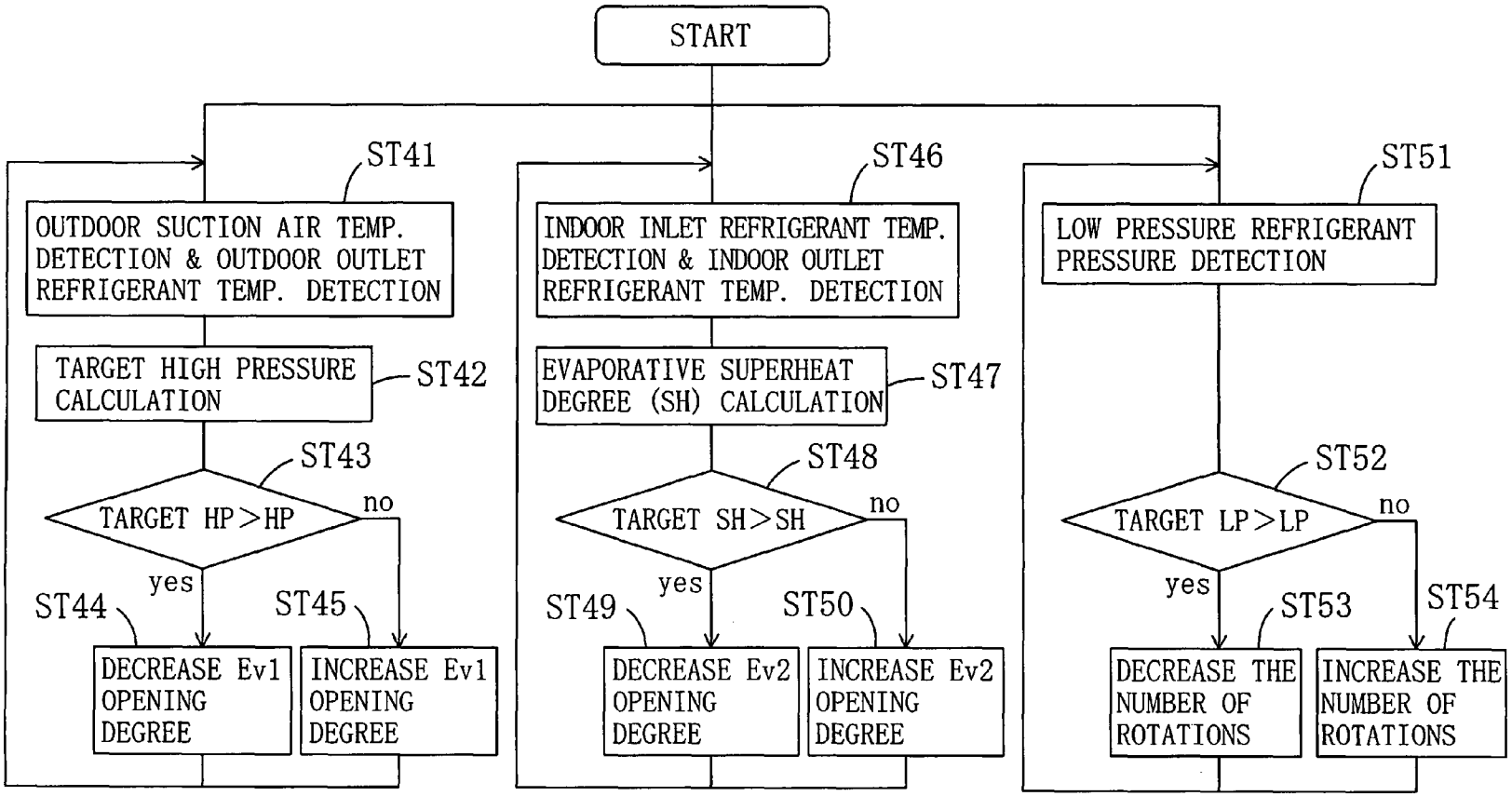
FIG. 13 is a control flow chart showing the control of the amount of throttling of a throttle mechanism and the control of the capacity of a compression mechanism in the cooling operation mode of the fourth embodiment.

The operation in the cooling operation mode is shown in FIG. 13. Steps ST41-ST50 are the same as steps ST1-ST10 (see FIG. 2) of the first embodiment.

That is, the outside air temperature sensor (55) detects the temperature of outside air and the first refrigerant temperature sensor (53) detects the temperature of refrigerant at the outlet of the outdoor heat exchanger (21) (step ST41). This is followed by step ST42, in which step the first control part (6*a*) of the high pressure control part (61) derives, from the detected outside air temperature and the detected outlet refrigerant temperature, a target value for the pressure of high pressure refrigerant. Thereafter, the first control part (6*a*) makes a decision of whether or not the high pressure refrigerant pressure detected by the high pressure sensor (51) exceeds the target value (step ST43). If it is decided that the detected high pressure refrigerant pressure falls below the target value, then the first control part (6*a*) provides control that reduces the degree of opening of the first throttle mechanism (41) (step ST44). On the other hand, if it is decided that the detected high pressure refrigerant pressure exceeds the target value, then the first control part (6*a*) provides control that increases the degree of opening of the first throttle mechanism (41) (step ST45). This operation is repeatedly carried out thereby to adjust the degree of opening of the first throttle mechanism (41).

On the other hand, the third refrigerant temperature sensor (56) detects the temperature of refrigerant at the inlet of the indoor heat exchanger (23) and the fourth refrigerant temperature sensor (58) detects the temperature of refrigerant at the outlet of the indoor heat exchanger (23) (step ST46). Subsequently, the second control part (6*b*) of the high pressure control part (61) derives, from the detected inlet refrigerant temperature and the detected outlet refrigerant temperature, the degree of refrigerant superheat at the outlet of the indoor heat exchanger (23) which is the degree of evaporation superheat (step ST47). Thereafter, the second control part (6*b*) makes a decision of whether or not the derived degree of superheat exceeds a predefined value (step ST48). If it is decided that the derived degree of superheat falls below the predefined value, then the second control part (6*b*) provides control that reduces the degree of opening of the second throttle mechanism (42) (step ST49). If it is decided that the derived degree of superheat exceeds the predefined value, then the second control part (6*b*) provides control that increases the degree of opening of the second throttle mechanism (42) (step ST50). This operation is repeatedly carried out thereby to adjust the degree of opening of the second throttle mechanism (42).

In addition, the low pressure sensor (52) detects the pressure of low pressure refrigerant (step ST51). The capacity control part (62) makes a decision of whether or not the detected low pressure refrigerant pressure exceeds a preset pressure value (step ST52). If it is decided that the detected low pressure refrigerant pressure falls below the preset pressure value, then the capacity control part (62) provides control that reduces the number of rotations of the compressor (32) (step ST53). On the other hand, if it is decided that the detected low pressure refrigerant pressure exceeds the preset pressure value, then the capacity control part (62) provides control that increases the number of rotations of the compressor (32) (step ST54). This operation is repeatedly carried out thereby to adjust the operation capacity of the compression mechanism (30).

Figure 14:
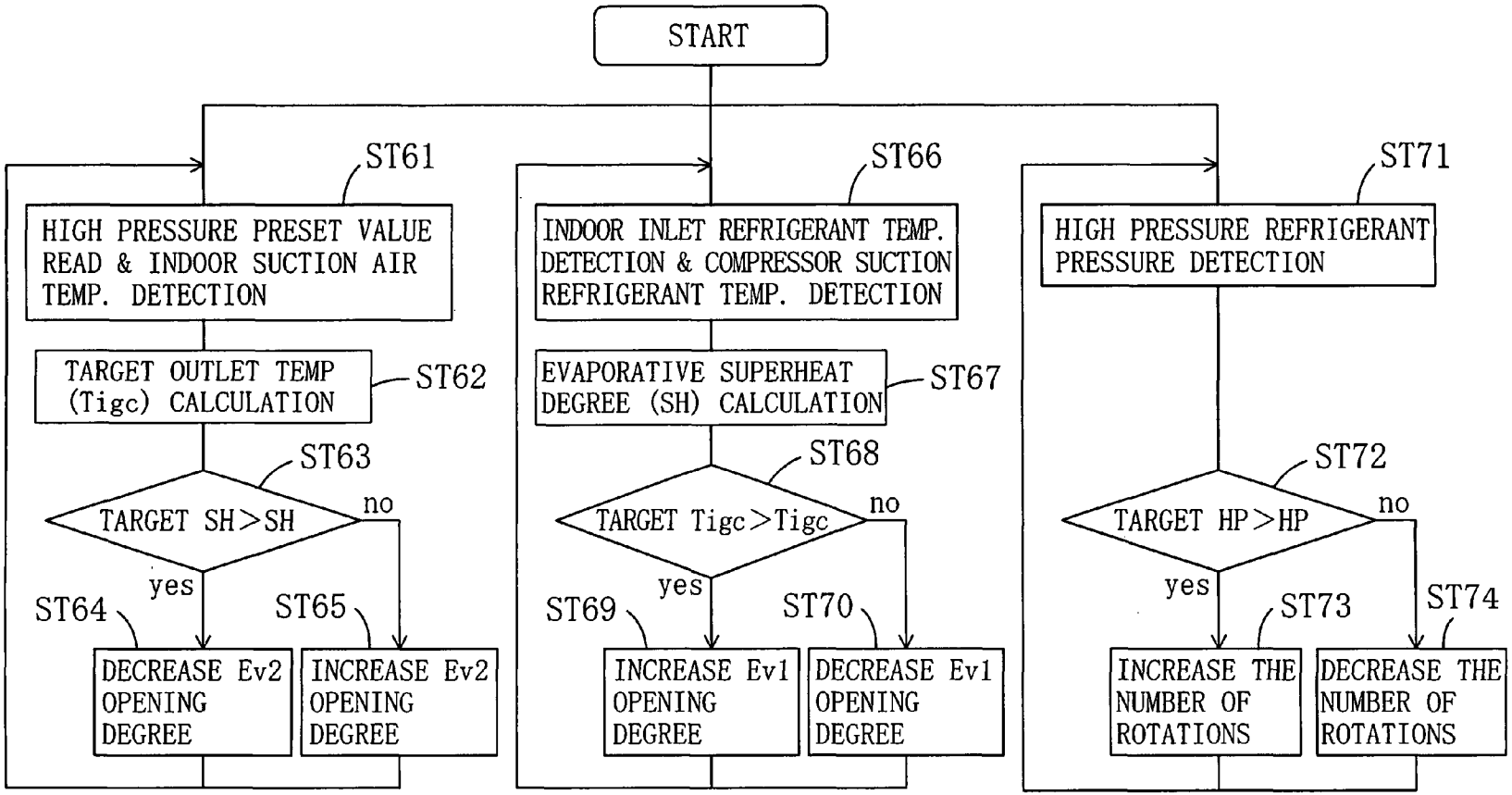
FIG. 14 is a control flow chart showing the control of the amount of throttling of a throttle mechanism and the control of the capacity of a compression mechanism in the heating operation mode of the fourth embodiment.

Referring to FIG. 14, in the heating operation mode, a preset pressure value for the pressure of high refrigerant pressure is read in and each room temperature sensor (57) detects the temperature of room air which is the temperature of suction air into each indoor heat exchanger (23) (step ST61). Subsequently, the first control part (6*c*) of the outlet temperature control part (63) derives, from the read-in preset pressure value of the high pressure refrigerant pressure and the detected temperature of room air, a target value for the outlet refrigerant temperature of each indoor heat exchanger (23) (step ST62).

Thereafter, the first control part (6*c*) of the outlet temperature control part (63) makes a decision of whether or not the outlet refrigerant temperature of the indoor heat exchanger (23) detected by the third refrigerant temperature sensor (56) exceeds the derived target value (step ST63). If it is decided that the detected outlet refrigerant temperature falls below the target value, then the degree of opening of the second throttle mechanism (42) is increased (step ST64), in other words, the amount of throttling thereof is reduced. Then, the control flow returns to step ST61.

If it is decided that the detected outlet refrigerant temperature exceeds the target value, then the degree of opening of the second throttle mechanism (42) is reduced (step ST65), in other words, the amount of throttling thereof is increased. Then, the control flow returns to step ST61. This operation is repeatedly carried out thereby to adjust the degree of opening of the second throttle mechanism (42).

On the other hand, the first refrigerant temperature sensor (53) detects the temperature of refrigerant at the inlet of the outdoor heat exchanger (21) and the second refrigerant temperature sensor (54) detects the temperature of refrigerant at the outlet of the outdoor heat exchanger (21), i.e., the temperature of suction refrigerant into the compression mechanism (30) (step ST66). Subsequently, the second control part (6*d*) of the outlet temperature control part (63) derives, from the detected inlet refrigerant temperature and the detected suction refrigerant temperature, the degree of outlet refrigerant superheat of the outdoor heat exchanger (21) which is the degree of evaporation superheat (step ST67).

Thereafter, the second control part (6*d*) of the outlet temperature control part (63) makes a decision of whether or not the derived degree of superheat exceeds a predefined value which is a target value for the degree of superheat) (step ST68). If it is decided that the derived degree of superheat falls below the predefined value, then the degree of opening of the first throttle mechanism (41) is reduced (step ST65), in other words, the amount of throttling thereof is increased. Then, the control flow returns to step ST26.

If it is decided that the derived degree of superheat exceeds the predefined value, then the degree of opening of the first throttle mechanism (41) is increased (step ST70), in other words, the amount of throttling thereof is reduced. Then, the control flow returns to step ST66. This operation is repeatedly carried out thereby to adjust the degree of opening of the first throttle mechanism (41).

In addition, the high pressure sensor (51) detects the pressure of high pressure refrigerant (step ST71) and makes a decision of whether or not the detected high pressure refrigerant pressure exceeds a preset pressure value (step ST72). If it is decided that the detected high pressure refrigerant pressure falls below the preset pressure value, then the number of rotations of the compressor (32) is increased (step ST73). On the other hand, if it is decided that the high pressure refrigerant pressure exceeds the preset pressure value, then the number of rotations of the compressor (32) is decreased (step ST74). This operation is repeatedly carried out thereby to adjust the operation capacity of the compression mechanism (30).

In addition, in the aforesaid steps ST52 and ST72, the target preset pressure value decreases the preset pressure value for the pressure of low pressure refrigerant in the cooling operation mode and increases the preset pressure value for the pressure of high pressure refrigerant in the heating operation mode, in response to the capacity increase signal outputted from each indoor unit (1B), and on the other hand, increases the preset pressure value for the pressure of low pressure refrigerant in the cooling operation mode and decreases the preset pressure value for the pressure of high pressure refrigerant in the heating operation mode, in response to the capacity decrease signal outputted from each indoor unit (1B).

At that time, each indoor unit (1B) outputs a capacity increase signal if the degree of opening of the second throttle mechanism (42) exceeds 80-90 percent of the degree of full opening thereof. On the other hand, each indoor unit (1B) outputs a capacity decrease signal if the degree of opening of the second throttle mechanism (42) falls below 10-20 percent of the degree of full opening thereof.

And the capacity control part (62) modifies the preset pressure value if the percentage of the number of indoor units (1B) that output a capacity increase signal reaches 20-40 percent while on the other hand the capacity control part (62) modifies the preset pressure value if the percentage of the number of indoor units (1B) that output a capacity decrease signal reaches 20-40 percent.

Advantageous Effects of the Fourth Embodiment

As described above, in the present embodiment, in the heating operation mode, the target value for the outlet refrigerant temperature of each indoor heat exchanger (23) is derived from the preset pressure value for the high pressure refrigerant pressure of the refrigerant circuit (20) and the temperature of room air, and the amount of throttling of the second throttle mechanism (42) is adjusted so that the aforesaid outlet refrigerant temperature becomes the target value, thereby making it possible that the operation is carried out in an operation state in which the coefficient of heating performance (COP) is optimized.

In addition, in the cooling operation mode, the high pressure control is provided by means of the first throttle mechanism (41) and the superheat degree control is provided by means of the second throttle mechanism (42) and, on the other hand, in the heating operation mode, the outlet temperature control is provided by means of the second throttle mechanism (42) and the superheat degree control is provided by means of the first throttle mechanism (41), whereby it becomes possible to maintain high pressure refrigerant and low pressure refrigerant in their respective optimum states.

In addition, the operation capacity of the compression mechanism (30) is controlled separately thereby to maintain it in an optimum operation state. Other effects of the control et cetera in the cooling operation mode are the same as in the first embodiment.

Fifth Embodiment of the Invention

Next, a fifth embodiment of the present invention will be described in detail with reference to the drawings.

Figure 15:
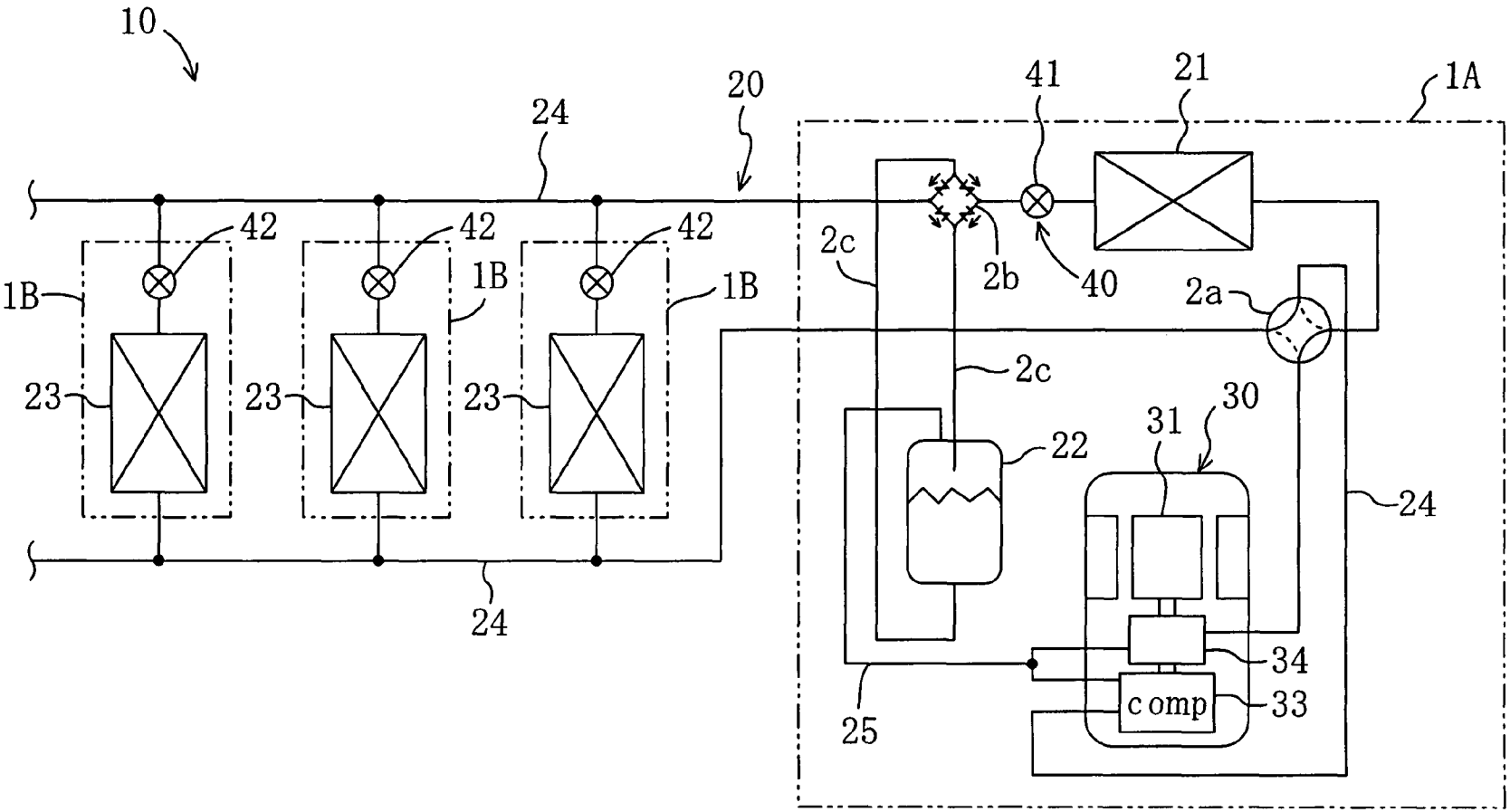
FIG. 15 is a refrigerant circuit diagram illustrating the configuration of a refrigeration system according to a fifth embodiment of the present invention.

Referring to FIG. 15, unlike the fourth embodiment which is provided with a single compressor (32), the present embodiment is an embodiment that is provided with two compressors (32).

More specifically, the compression mechanism (30) is provided with a lower stage compressor (33) and a higher stage compressor (34). And the injection passageway (25) is connected to between the lower stage compressor (33) and the higher stage compressor (34). Other configurations and operation/working effects are the same as in the fourth embodiment.

Sixth Embodiment of the Invention

Next, a sixth embodiment of the present invention will be described in detail with reference to the drawings.

Figure 16:
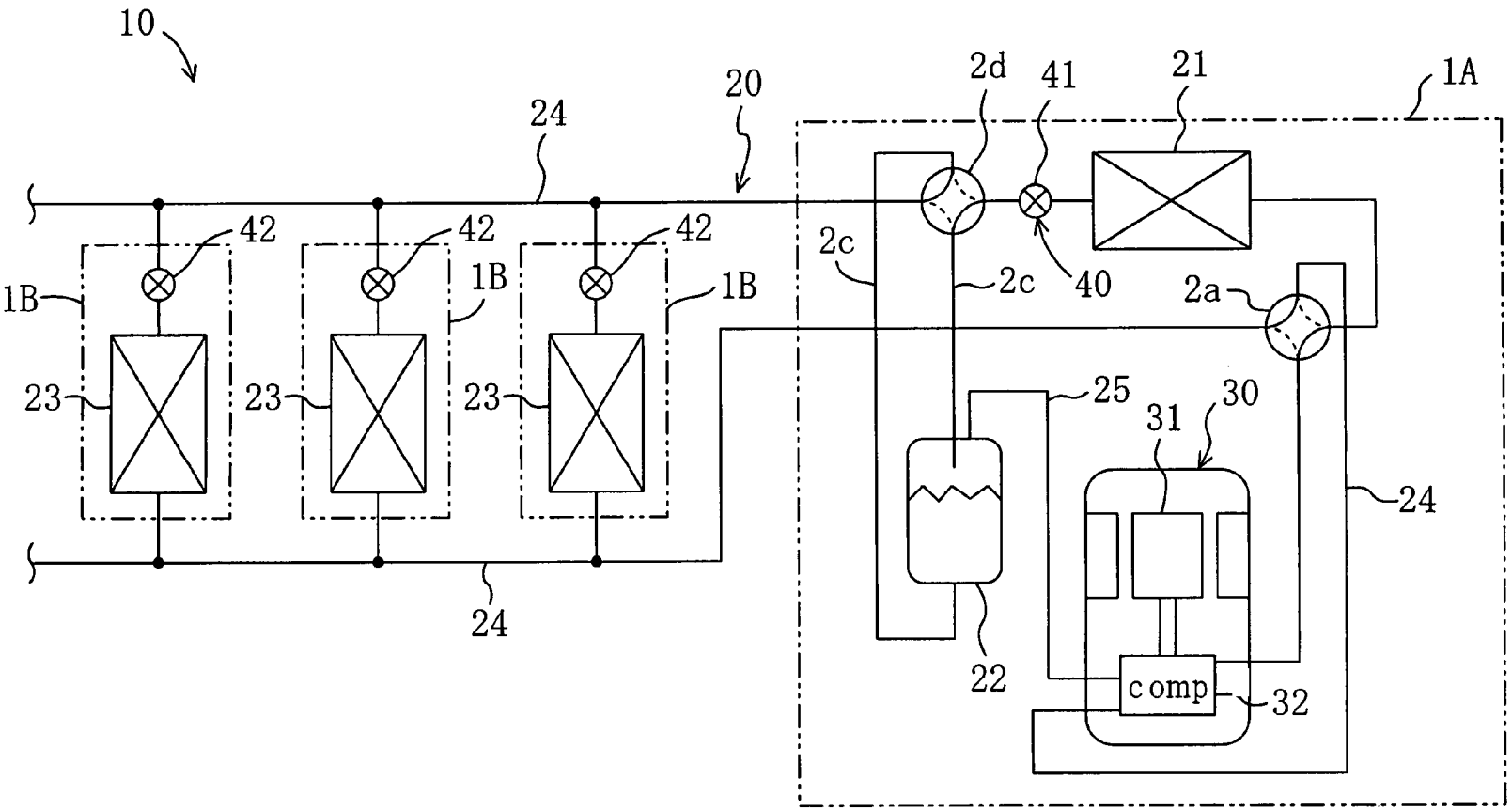
FIG. 16 is a refrigerant circuit diagram illustrating the configuration of a refrigeration system according to a sixth embodiment of the present invention.

Referring to FIG. 16, the present embodiment is an embodiment that is provided with a switching mechanism (2*d*) in place of the flow rectification circuit (2*b*) as provided in the fourth embodiment that.

More specifically, the switching mechanism (2*d*) is implemented by a four-way selector valve having four ports, two of which are connected through the first throttle mechanism (41) to the outdoor heat exchanger (21) and another two of which are connected through the second throttle mechanism (42) to the indoor heat exchanger (23).

Furthermore, the one-way passageway (2*c*) is connected to between the other two ports of the switching mechanism (2*d*). The one-way passageway (2*c*) is provided with the gas-liquid separator (22). The upstream side of the one-way passageway (2*c*) is connected to the top of the gas-liquid separator (22) and the downstream side of the one-way passageway (2*c*) is connected to the bottom of the gas-liquid separator (22). Other configurations and operation/working effects are the same as in the fourth embodiment.

Other Embodiments

With respect to the conditions for the capacity increase and decrease signals outputted from each indoor unit (1B), the present invention is not limited to the fourth embodiment.

In addition, in the fourth embodiment, the way of controlling the capacity of the compression mechanism (30) is not limited only to the change in the preset pressure value.

Additionally, the air conditioner (10) of each of the first to third embodiments may be an air conditioner configured to provide only room cooling or an air conditioner configured to provide only room heating. At that time, for the case of the air conditioner configured to provide only room heating, the outlet temperature control part (63) of the fourth embodiment may be used as a substitute for the high pressure control part (61).

In addition, it is arranged such that the high pressure control part (61) of each of the aforesaid embodiments derives, from the outlet refrigerant temperature of the heat dissipation side heat exchanger and the inlet medium temperature of the heat dissipation side heat exchanger, a target value for the pressure of high pressure refrigerant. However, it may be arranged such that the high pressure control part (61) uses, as an additional parameter, the saturated pressure corresponding to the temperature of refrigerant in the heat absorption side heat exchanger, and derives, from the outlet refrigerant temperature, the inlet medium temperature, and the saturated pressure corresponding to the refrigerant temperature, a target value for the high pressure refrigerant pressure of the refrigerant circuit (20). In this case, it becomes possible to more accurately derive a target value for the pressure of high pressure refrigerant.

To sum up, in the cooling operation mode, it may be arranged such that the outlet refrigerant temperature of the outdoor heat exchanger (21), the temperature of outside air, and the evaporative pressure or evaporative temperature in the indoor heat exchanger (23) are used to obtain a target value for the pressure of high pressure refrigerant. On the other hand, in the heating operation mode, it may be arranged such that the outlet refrigerant temperature of the indoor heat exchanger (23), the temperature of room air, and the evaporative pressure or evaporative temperature in the outdoor heat exchanger (21) are used to obtain a target value for the pressure of high pressure refrigerant.

In addition, the second control part (6*b*, 6*d*) of each of the foregoing embodiments is configured to provide control of the degree of superheat. However, in the first to third aspects of the present invention, the operation of the second control part (6*b*, 6*d*) is not limited to controlling the degree of superheat.

Moreover, in the first to third aspects of the present invention, it may be arranged such that high pressure control and outlet temperature control are provided by the first throttle mechanism (41) and the second throttle mechanism (42).

In addition, although each of the foregoing embodiments has been described in terms of the air conditioner (10), the present invention can be applied to various types of refrigeration systems configured to operate in the cooling operation mode for cold/freeze storage or in the heating operation mode.

Moreover, the medium, used for the exchange of heat with the refrigerant in the outdoor and indoor heat exchangers (21, 23) of each of the foregoing embodiments, is not limited to air. Alternatively, water or brine may be used.

In addition, the refrigerant is not limited to carbon dioxide. The type of the expansion mechanism (40) is not limited to an expansion valve and any means may be employed as the expansion mechanism (40) so long as it is variable in the amount of throttling.

It should be noted that the above-described embodiments are merely preferable exemplifications in nature and are no way intended to limit the scope of the present invention, its application, or its application range.

INDUSTRIAL APPLICABILITY

As has been described above, the present invention finds utility in the field of measures for the coefficient of performance in a supercritical refrigeration cycle refrigeration system.

The invention claimed is:

1. A refrigeration system, comprising:

a refrigerant circuit that, in order to perform a vapor compression supercritical refrigeration cycle, includes a compression mechanism, a heat source side heat exchanger, an expansion mechanism, and a utilization side heat exchanger, wherein the expansion mechanism includes, for two-stage compression of refrigerant in the refrigerant circuit, a high pressure side throttle mechanism variable in the amount of throttling and a low pressure side throttle mechanism variable in the amount of throttling; and a high pressure controller configured to for each temperature of a medium exchanging heat with refrigerant in either the heat source side heat exchanger or the utilization side heat exchanger, whichever becomes a heat dissipation side heat exchanger functioning as a heat dissipation unit, at the inlet of the heat dissipation side heat exchanger, store a relationship between the temperature of refrigerant at the outlet of the heat dissipation side heat exchanger and the pressure of high pressure refrigerant in the refrigerant circuit, for each temperature of the medium at the inlet of the heat dissipation side heat exchanger, store a relationship between a COP and the temperature of refrigerant at the outlet of the heat dissipation side heat exchanger and a relationship between the COP and the pressure of the high pressure refrigerant in the refrigerant circuit, and derive a target value, providing a maximum COP, for the pressure of high pressure refrigerant in the refrigerant circuit based on i) the temperature of refrigerant at the outlet of the heat dissipation side heat exchanger and ii) the temperature of the medium at the inlet of the heat dissipation side heat exchanger, and the high pressure controller further configured to adjust the amount of throttling of the expansion mechanism so that the high pressure refrigerant pressure is controlled to the derived target value.

2. The refrigeration system of claim 1, wherein the high pressure controller includes a first control part for adjusting the amount of throttling of the high pressure side throttle mechanism for high pressure control and a second control part for adjusting the amount of throttling of the low pressure side throttle mechanism so that the degree of outlet refrigerant superheat of either the heat source side heat exchanger or the utilization side heat exchanger, whichever becomes a heat absorption side heat exchanger functioning as a heat absorption unit, becomes a predefined value.

3. The refrigeration system of claim 1, wherein the high pressure controller is configured to derive a target value for the pressure of high pressure refrigerant in the refrigerant circuit from, in addition to the outlet refrigerant temperature of the heat dissipation side heat exchanger and the inlet medium temperature of the heat dissipation side heat exchanger, the saturated pressure corresponding to the temperature of refrigerant in either the heat source side heat exchanger or the utilization side heat exchanger, whichever becomes a heat absorption side heat exchanger functioning as a heat absorption unit.

4. A refrigeration system, comprising:

a refrigerant circuit that, in order to perform a vapor compression supercritical refrigeration cycle, includes a compression mechanism, a heat source side heat exchanger, an expansion mechanism, and a utilization side heat exchanger, wherein the expansion mechanism includes, for two-stage compression of refrigerant in the refrigerant circuit, a high pressure side throttle mechanism variable in the amount of throttling, and a low pressure side throttle mechanism variable in the amount of throttling; and an outlet temperature controller configured to for each temperature of a medium exchanging heat with refrigerant in the utilization side heat exchanger functioning as a heat dissipation unit, at the inlet of the utilization side heat exchanger, store a relationship between the temperature of refrigerant at the outlet of the utilization side heat exchanger and the pressure of high pressure refrigerant in the refrigerant circuit, for each temperature of the medium at the inlet of the utilization side heat exchanger, store a relationship between a COP and the temperature of refrigerant at the outlet of the utilization side heat exchanger and a relationship between the COP and the pressure of the high pressure refrigerant in the refrigerant circuit, and derive, in a heating operation mode of the refrigerant circuit, a target value, providing a maximum COP, for the temperature of refrigerant at the outlet of the utilization side heat exchanger based on i) the temperature of the medium at the inlet of the utilization side heat exchanger and ii) a preset pressure value for the pressure of high pressure refrigerant in the refrigerant circuit, and the outlet temperature controller further configured to adjust the amount of throttling of the expansion mechanism so that the outlet refrigerant temperature is controlled to the target value.

5. The refrigeration system of claim 4, wherein the outlet temperature controller includes a first control part for adjusting the amount of throttling of the high pressure side throttle mechanism for outlet temperature control and a second control part for adjusting the amount of throttling of the low pressure side throttle mechanism so that the degree of outlet refrigerant superheat of the heat source side heat exchanger becomes a predefined value.

6. The refrigeration system of either claim 1 or claim 4, further comprising:

a capacity controller configured to provide, in response to a capacity increase or decrease signal outputted from a utilization side unit in which the utilization side heat exchanger is housed, increase/decrease control of the operation capacity of the compression mechanism.

7. The refrigeration system of claim 6, wherein the utilization side unit is configured to output, based on the inlet medium temperature of the utilization side heat exchanger and the preset temperature, a capacity increase or decrease signal.

8. A refrigeration system, comprising:

a refrigerant circuit that, in order to perform a vapor compression supercritical refrigeration cycle, includes a compression mechanism, a heat source side heat exchanger, an expansion mechanism, and a plurality of utilization side heat exchangers connected in parallel with each other, wherein the expansion mechanism includes, for two-stage compression of refrigerant in the refrigerant circuit, a heat source side throttle mechanism variable in the amount of throttling and associated with the heat source side heat exchanger, and a plurality of utilization side throttle mechanisms variable in the amount of throttling and associated respectively with the plurality of utilization side heat exchangers;

a high pressure controller configured to for each temperature of a medium exchanging heat with refrigerant in the heat source side heat exchanger functioning as a heat dissipation unit, at the inlet of the heat source side heat exchanger, store a relationship between the temperature of refrigerant at the outlet of the heat source side heat exchanger and the pressure of high pressure refrigerant in the refrigerant circuit, and, for each temperature of the medium at the inlet of the heat source side heat exchanger, store a relationship between a COP and the temperature of refrigerant at the outlet of the heat source side heat exchanger and a relationship between the COP and the pressure of the high pressure refrigerant in the refrigerant circuit, for each temperature of a medium exchanging heat with refrigerant in the utilization side heat exchanger functioning as a heat dissipation unit, at the inlet of the utilization side heat exchanger, store a relationship between the temperature of refrigerant at the outlet of the utilization side heat exchanger and the pressure of the high pressure refrigerant in the refrigerant circuit, and, for each temperature of the medium at the inlet of the utilization side heat exchanger, store a relationship between the COP and the temperature of refrigerant at the outlet of the utilization side heat exchanger and a relationship between the COP and the pressure of the high pressure refrigerant in the refrigerant circuit, and derive, in a cooling operation mode of the refrigerant circuit, a target value, providing a maximum COP, for the pressure of high pressure refrigerant in the refrigerant circuit based on i) the temperature of the refrigerant at the outlet of the heat source side heat exchanger, and ii) the temperature of the medium at the inlet of the heat source side heat exchanger; and the high pressure controller further configured to adjust the amount of throttling of the expansion mechanism so that the high pressure refrigerant pressure is controlled to the target value; and an outlet temperature controller configured to derive, in a heating operation mode of the refrigerant circuit, a target value, providing a maximum COP, for the temperature of refrigerant at the outlet of the utilization side heat exchanger based on i) the temperature of the medium at the inlet of the utilization side heat exchanger and ii) a preset pressure value for the pressure of high pressure refrigerant in the refrigerant circuit, and the outlet temperature controller is configured to adjust the amount of throttling of the expansion mechanism so that the outlet refrigerant temperature is controlled to the target value.

9. The refrigeration system of claim 8, wherein the high pressure controller includes a first control part for adjusting the amount of throttling of the heat source side throttle mechanism for high pressure control and a second control part for adjusting the amount of throttling of the utilization side throttle mechanism so that the degree of outlet refrigerant superheat of the utilization side heat exchanger becomes a predefined value; and wherein the outlet temperature controller includes a first control part for adjusting the amount of throttling of the utilization side throttle mechanism for outlet temperature control and a second control part for adjusting the amount of throttling of the heat source side throttle mechanism so that the degree of outlet refrigerant superheat of the heat source side heat exchanger becomes a predefined value.

10. The refrigeration system of any one of claim 8, wherein the refrigerant circuit includes a gas-liquid separator arranged between the two throttle mechanisms of the expansion mechanism and an injection passageway through which to direct gas refrigerant in the gas-liquid separator to an intermediate pressure region of the compression mechanism.

11. The refrigeration system of claim 10, wherein the compression mechanism includes a lower stage compressor and a higher stage compressor; and wherein the injection passageway is configured such that gas refrigerant is directed to the intermediate pressure region between the lower stage compressor and the higher stage compressor.

12. The refrigeration system of claim 8, wherein the high pressure controller is configured to derive a target value for the pressure of high pressure refrigerant in the refrigerant circuit from, in addition to the outlet refrigerant temperature of the heat source side heat exchanger and the inlet medium temperature of the heat source side heat exchanger, the saturated pressure corresponding to the temperature of refrigerant in the utilization side heat exchanger.

13. The refrigeration system of claim 8, further comprising:

a capacity controller configured to control the operation capacity of the compression mechanism so that in the cooling operation mode, the low pressure refrigerant pressure of the refrigerant circuit becomes a preset pressure value, and the capacity controller further configured to control the operation capacity of the compression mechanism so that in the heating operation mode, the high pressure refrigerant pressure of the refrigerant circuit becomes a preset pressure value.

14. The refrigeration system of claim 13, wherein the capacity controller is configured such that:

in response to a capacity increase signal outputted from a utilization side unit in which the utilization side heat exchanger is housed, the preset pressure value for the pressure of low pressure refrigerant in the cooling operation mode is decreased while the preset pressure value for the pressure of high pressure refrigerant in the heating operation mode is increased; and in response to a capacity decrease signal outputted from the utilization side unit, the preset pressure value for the pressure of low pressure refrigerant in the cooling operation mode is increased while the preset pressure value for the pressure of high pressure refrigerant in the heating operation mode is decreased.

15. The refrigeration system of claim 14, wherein the utilization side throttle mechanism is formed by an expansion valve variable in the degree of opening thereof; and wherein the utilization side unit is so configured as to output:

a capacity increase signal if the degree of opening of the utilization side throttle mechanism exceeds a predefined change value; and a capacity decrease signal if the degree of opening of the utilization side throttle mechanism falls below the predefined change value.

16. The refrigeration system of claim 15, wherein the utilization side unit is configured such that:

a capacity increase signal is outputted if the degree of opening of the utilization side throttle mechanism exceeds 90 percent of the degree of full opening thereof; and a capacity decrease signal is outputted if the degree of opening of the utilization side throttle mechanism falls below 10 percent of the degree of full opening thereof.

17. The refrigeration system of claim 14, wherein the capacity controller is configured such that the preset pressure value is modified:

if the number of utilization side units that output a capacity increase signal reaches a predefined percentage; and if the number of utilization side units that output a capacity decrease signal reaches a predefined percentage.

18. The refrigeration system of claim 17, wherein the predefined percentage of the number of utilization side units at which the capacity controller modifies the preset pressure value is set between 20 and 40 percent.

* * * * *